US005521039A

United States Patent [19]

Hoshi et al.

[11] Patent Number: 5,521,039

[45] Date of Patent: May 28, 1996

[54] ELECTROPHOTOGRAPHIC PHOTOSENSITIVE MATERIAL AND PRINTING PLATE FOR ELECTROPHOTOGRAPHIC PROCESS

[75] Inventors: Satoshi Hoshi; Naonori Makino; Katsuji Kitatani, all of Shizuoka, Japan

[73] Assignee: Fuji Photo Film Co., Ltd., Kanagawa, Japan

[21] Appl. No.: 351,119

[22] Filed: Nov. 30, 1994

[30] Foreign Application Priority Data

Nov. 30, 1993 [JP] Japan ..... 5-300291

[51] Int. Cl.[6] ..... G03G 13/32

[52] U.S. Cl. ..... 430/49; 430/58; 430/76

[58] Field of Search ..... 430/58, 76, 78, 430/49

[56] References Cited

U.S. PATENT DOCUMENTS 4,504,559 3/1985 Makino et al. ..... 430/58

*Primary Examiner*—John Goodrow

*Attorney, Agent, or Firm*—Sughrue, Mion, Zinn, Macpeak & Seas

[57] ABSTRACT

An electrophotographic photosensitive material comprising a conductive support having thereon (a) a layer containing a charge transporting compound and a charge generating compound or (b) a combination of a layer containing a charge transporting compound and a layer containing a charge generating compound, wherein a novel disazo compound is contained as the charge generating compound, and a printing plate for electrophotographic process, which is prepared by subjecting an electrophotographic photosensitive material comprising a conductive support having thereon a photoconductive layer containing at least a charge generating material, a charge transporting material and a binder resin to an imagewise exposure and a development to form a toner image, and by removing a non-image area of the photoconductive layer other than the toner image area thereof, wherein at least one charge generating material is a novel disazo compound.

2 Claims, No Drawings

ELECTROPHOTOGRAPHIC PHOTOSENSITIVE MATERIAL AND PRINTING PLATE FOR ELECTROPHOTOGRAPHIC PROCESS

FIELD OF THE INVENTION

This invention relates to an electrophotographic photosensitive material and a printing plate for electrophotographic process. More particularly, it relates to the electrophotographic photosensitive material comprising a layer containing a novel charge-generating material or a layer containing a novel photoconductive material, and to the printing plate for the electrophotographic process which mainly comprises a novel charge-generating material, a charge-transporting material and an alkali-soluble binding resin.

BACKGROUND OF THE INVENTION

Photoconductive compounds which have so far been well known are inorganic materials including selenium, cadmium sulfide, zinc oxide, amorphous silicon and the like. These inorganic materials have an advantage of being endowed with satisfactory electrophotographic characteristics, namely very high photoconductivity and sufficient charge acceptance and insulation in the dark. On the other hand, they have also various disadvantages. More specifically, a selenium photosensitive material has disadvantages, e.g., in that it is high in production cost, lacks of flexibility and is weak in heat and mechanical impact; a cadmium sulfite photosensitive material has the problem of environmental pollution since cadmium known as a poisonous material is used as a raw material; a zinc oxide photosensitive material has difficulty in securing the image stability upon repeated use for a long term; and an amorphous silicon photosensitive material is extremely high in production cost and requires a special surface treatment for preventing its surface from deteriorating.

In recent years, electrophotographic photosensitive materials using various organic materials have been proposed with the intention of obviating the defects arising from those inorganic materials, and some of them have been put to practical use. For instance, the electrophotographic photosensitive material comprising poly-N-vinylcarbazole and 2,4,7-trinitrofluorenone-9-one (U.S. Pat. No. 3,484,237), the electrophotographic photosensitive material comprising poly-N-vinylcarbazole sensitized with a pyrylium salt dye (JP-B-48-25658, the term "JP-B" as used herein means an "examined Japanese patent publication"), and the electrophotographic photosensitive material containing as a main component the eutectic crystal complex comprising a dye and a resin (JP-A-47-10735, the term "JP-A" as used herein means an "unexamined published Japanese patent application") are disclosed.

Further, recently, the electrophotographic photosensitive materials containing as a main component an organic pigment such as perylene pigments (e.g., U.S. Pat. No. 3,371,884), phthalocyanine pigments (e.g., U.S. Pat. Nos. 3,397,086, 4,666,802), azulenium salt pigments (e.g., JP-A-59-53850, JP-A-61-212542), squalium salt pigments (e.g., U.S. Pat. Nos. 4,396,610, 4,644,082) and polycyclic quinone pigments (e.g., JP-A-59-184348, JP-A-62-28738), and those containing as a main component an azo pigment as cited below have been studied. As a result, a great number of proposals have been made.

As for the azo pigments which have so far been studied, disazo pigments are disclosed in JP-A-53-133445, JP-A-59-78356, JP-A-59-128547, JP-A-61-57945, JP-A-61-17150, JP-A-62-251752, JP-A-62-273545, JP-B-63-18740, U.S. Pat. No. 4,504,559, JP-A-64-13555, JP-A-64-79753 and JP-B-2-4893, trisazo pigments are disclosed in JP-A-58-160358, JP-A-61-251865, JP-B-62-39626 and JP-B-63-10419, and tetrakisazo pigments are disclosed in JP-A61-182051 and JP-A-62-18565.

On the other hand, for example, presensitized plates using a positive working photosensitive material which contains a quinonediazide compound and a phenol resin as main components, and those using a negative working photosensitive material which contains an acrylic monomer or prepolymer as a main component, have been practically used as lithographic offset printing plates. Since these plates are all low in sensitivity, it is required of them to be in close contact with an original film, on which images have been recorded previously, in the exposure operation for producing therefrom the printing plates. In the meantime, owing to progress in both computer technology, including graphic processing and bulk data storage, and data communication technology, there has lately been put to practical use an electronic editing system in which a series of operations, involving input of original manuscript, amendment, compilation, layout and page make-up, are performed from first to last with a computer and the thus edited manuscript is transmitted immediately as the output to remote terminal plotters by a high-speed communications network or satellite communication. In particular, there is a great demand for the electronic editing system in the field of newspaper printing which requires the immediacy. Further, in a field such that original manuscripts are stored in the form of film and printing plates are reproduced from the films picked out among the stored ones in answer to requests, it can be expected that the development of bulk recording media such as an optical disc enables those original manuscripts to be stored as digital data in such recording media.

However, direct type printing plates, or printing plates produced directly from the output of a terminal plotter, rarely have practical utility. Even in the case that the electronic editing system is working, therefore, it is the present situation that a printing plate is produced by the method comprising the steps of recording the output on a silver salt photographic film, bringing the resulting film into contact with a presensitized plate and then performing an exposure operation. One reason for adoption of this method is that there have been difficulties in developing presensitized plates having sensitivities sufficient for the production of direct type printing plates within a practical time by the use of the light source of an output plotter (e.g., He—Ne laser, semiconductor laser).

As a photosensitive material having high photosensitivity enough to provide the direct type printing plate, an electrophotographic photosensitive material has been proposed.

Electrophotography utilized printing plate materials (original plates for printing) which have hitherto known include, e.g., the ZnO-resin dispersion offset printing plate materials disclosed, e.g., in JP-B-47-47610, JP-B-48-40002, JP-B-48-18325, JP-B-51-15766 and JP-B-51-25761. In using these materials as printing plates, they are wetted with a desensitizing solution (e.g., an acidic aqueous solution containing a ferrocyanate or ferricyanate) after the toner image formation by electrophotography, thereby desensitizing the non-image area. The offset printing plates which have undergone such a treatment as described above have an impression capacity of from 5,000 to 10,000 sheets. Those plates are unsuitable for more than 10,000 sheets of printing, and have a defect such that when the plate materials are designed so as to have a composition suitable for desensitization, they suffer from deterioration of electrostatic characteristics, and so the resulting plates cannot provide images of good quality. Further, there is a problem that a harmful cyan compound is used as a desensitizing solution.

In the organic photoconductive-resin printing plate materials disclosed, e.g., in JP-B-37-17162, JP-B-38-7758, JP-B-46-39405 and JP-B-52-2437, used are electrophotographic photosensitive materials in which a photoconductive insulation layer comprising, e.g., an oxazole or oxadiazole compound bound with a styrene-maleic anhydride copolymer is provided on a grained aluminum plate. After toner images are formed on these photosensitive materials by electrophotography, the non-image areas are removed by the dissolution in an alkaline organic solvent.

Further, the electrophotographically photosensitive printing plate material containing a hydrazone compound and barbituric or thiobarbituric acid is disclosed in JP-A-57-147656. Besides this material, there are known the dye-sensitized printing plates for electrophotographic process disclosed in, for example, JP-A-59-147335, JP-A-59-152456, JP-A-59-168462, JP-A-58-145495. However, such dye-sensitized printing plates failed in attaining sufficient sensitivity. Accordingly, there were held great expectations for the development of photoconductors having higher sensitivity.

As other means for realizing higher sensitivity, the photosensitive printing plate comprises a charge carrier generating compound dispersed in a resin binder, wherein a phthalocyanine compound, an azo compound or a condensed polycyclic quinone compound is used as the charge carrier generating compound, are known, e.g., in JP-A-55-161250, JP-A-56-146145 and JP-A-60-17751, yet they cannot be said to have sufficiently high sensitivity or satisfactory charge retention characteristics.

Although conventional organic electrophotographic photosensitive materials have appreciable improvements in mechanical characteristics and flexibility over the aforementioned inorganic ones, their sensitivities are still insufficient and some of them cause changes in electric characteristics by frequently repeated use. In other words, they do not always meet satisfactorily all the conditions required of an electrophotographic photosensitive material.

In addition, the sensitivities of the above-cited printing plates for electrophotographic process are generally insufficient for direct preparation of press plates without using any process film. In exceptional cases that the printing plates have high sensitivities, they are still insufficient for direct preparation of press plates because of some problems including their unsatisfactory charge retention characteristics.

SUMMARY OF THE INVENTION

Therefore, an object of the present invention is to provide a novel electrophotographic photosensitive material having high sensitivity and high durability.

Another object of the present invention is to provide a novel electrophotographic photosensitive material which has less deterioration in photosensitivity upon repeated use.

A further object of the present invention is to provide a printing plate for an electrophotographic process which has high sensitivity enough for direct printing by means of laser and so on.

Still another object of the present invention is to provide a printing plate having excellent electrostatic characteristics for electrophotographic process.

Yet still other object of the present invention is to provide a printing plate having excellent printing characteristics for electrophotographic process.

These and other objects of the present invention can be attained with an electrophotographic photosensitive material comprising a conductive support having thereon (a) a layer containing a charge transporting compound and a charge generating compound or (b) a combination of a layer containing a charge transporting compound and a layer containing a charge generating compound, wherein a disazo compound represented by the following formula (I) as the charge generating compound is contained.

Further, these and other objects of the present invention can be achieved by a printing plate for electrophotographic process, which is prepared by subjecting an electrophotographic photosensitive material comprising a conductive support having thereon a photoconductive layer containing at least a charge generating material, a charge transporting material and a binder resin to an imagewise exposure and a development to form a toner image, and by removing a non-image area of the photoconductive layer other than the toner image areas thereof, wherein at least one charge generating material is a disazo compound represented by the following formula (I).

The above-described formula (I) is as follows:

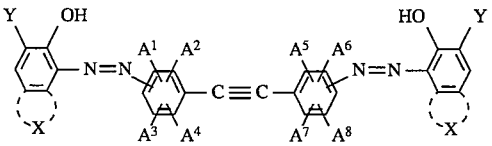

(I)

wherein $A^1$, $A^2$, $A^3$, $A^4$, $A^5$, $A^6$, $A^7$ and $A^8$ each independently represents a hydrogen atom, a substituted or unsubstituted alkyl group, an alkoxy group, a hydroxyl group, a cyano group, a nitro group, a halogen atom, a trifluoromethyl group, an amino group, a carboxyl group, an alkoxycarboxyl group, an aryloxycarboxyl group, an alkylcarbonyl group or an arylcarbonyl group; X represents an atomic group necessary for forming an aromatic ring or a heteroaromatic ring by fusing together with a benzene ring in formula (I) to which a hydroxyl group and Y are attached; and Y represents $—CONR^1R^2$ or $—COOR^2$, in which $R^1$ represents a hydrogen atom, an alkyl group or an aryl group; and $R^2$ represents a group represented by the following formula (II):

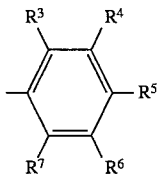

(II)

wherein $R^3$, $R^4$, $R^5$, $R^6$ and $R^7$ each independently represents a hydrogen atom, an alkyl group, an alkoxy group, a hydroxyl group, a cyano group, a nitro group, a halogen atom, a trifluoromethyl group, an amino group, a carboxyl group, an alkylcarbonyl group or an arylcarbonyl group, provided that at least one of $R^3$, $R^4$, $R^5$, $R^6$ and $R^7$ is a group selected from $—CO_2R^8$, $—CONR^9R^{10}$, $—SO_2R^8$, $—SO_3H$, $—SO_2NR^9R^{10}$, $—NR^9COR^{11}$ and $—NR^9SO_2R^{11}$, in which $R^8$ represents an alkyl group, an aryl group or a heteroaromatic ring group; and $R^9$, $R^{10}$ and $R^{11}$ each independently represents a hydrogen atom, an alkyl group or an aryl group.

DETAILED DESCRIPTION OF THE INVENTION

The disazo compounds represented by formula (I) according to the present invention are described below in detail.

$A^1$, $A^2$, $A^3$, $A^4$, $A^5$, $A^6$, $A^7$ and $A^8$ ($A^1$ to $A^8$) are the same or different, and each preferably represents a hydrogen atom, a substituted or unsubstituted straight-chain or branched alkyl group having from 1 to 12 carbon atoms (e.g., methyl, ethyl, n-propyl, i-propyl, n-butyl, i-butyl, t-butyl, pentyl, hexyl, isoamyl, isohexyl, neopentyl), an alkoxy group having from 1 to 12 carbon atoms (e.g., methoxy, ethoxy, n-propoxy, i-propoxy, n-butoxy, i-butoxy, t-butoxy), a hydroxyl group, a cyano group, a nitro group, a halogen atom (e.g., chlorine, bromine, fluorine), a trifluoromethyl group, an amino group, a carboxyl group, an alkoxycarbonyl group having from 2 to 13 carbon atoms (e.g., methoxycarbonyl, ethoxycarbonyl, n-propoxycarbonyl, i-propoxycarbonyl, n-butoxycarbonyl, i-butoxycarbonyl, t-butoxycarbonyl), an aryloxycarbonyl group having from 7 to 15 carbon atoms (e.g., phenyloxycarbonyl, naphthyloxycarbonyl, biphenyloxycarbonyl, anthraoxycarbonyl), an alkylcarbonyl group having from 2 to 13 carbon atoms (e.g., methylcarbonyl, ethylcarbonyl, propylcarbonyl, butylcarbonyl) or an arylcarbonyl group having from 7 to 15 carbon atoms (e.g., phenylcarbonyl, naphthylcarbonyl, biphenylcarbonyl, anthranylcarbonyl). More preferably, $A^1$ to $A^8$ are each a hydrogen atom, an alkyl group having from 1 to 4 carbon atoms, an alkoxy group having from 1 to 4 carbon atoms, or a halogen atom.

When $A^1$ to $A^8$ represent the substituted alkyl group, examples of the substituent of the substituted alkyl group include a hydroxyl group, an alkoxy group having from 1 to 12 carbon atoms, a cyano group, an amino group, an alkylamino group having from 1 to 12 carbon atoms, a dialkylamino group containing two alkyl groups each having from 1 to 12 carbon atoms, a halogen atom, and an aryl group having from 6 to 15 carbon atoms. Specific examples of such substituted alkyl groups include a hydroxyalkyl group (e.g., hydroxymethyl, 2-hydroxyethyl, 3-hydroxypropyl, 2-hydroxypropyl), an alkoxyalkyl group (e.g., methoxymethyl, 2-methoxyethyl, 3-methoxypropyl, ethoxymethyl, 2-ethoxyethyl), a cyanoalkyl group (e.g., cyanomethyl, 2-cyanoethyl), an aminoalkyl group (e.g., aminomethyl, 2-aminoethyl, 3-aminopropyl), an (alkylamino)alkyl group [e.g., (methylamino)methyl, 2-(methylamino)ethyl, (ethylamino)methyl], a (dialkylamino)alkyl group [e.g., (dimethylamino)methyl, 2-(dimethylamino)ethyl], a halogenoalkyl group (e.g., fluoromethyl, trifluoromethyl, chloromethyl) and an aralkyl group (e.g., benzyl, phenethyl).

X is an atomic group necessary for forming an aromatic ring (e.g., a naphthalene ring, an anthracene ring) or a heteroaromatic ring (e.g., an indole ring, a carbazole ring, a benzocarbazole ring, a dibenzofuran ring) by fusing together with the benzene ring in formula (I) to which a hydroxyl group and Y are attached.

When the group represented by X forms a substituted aromatic ring or a substituted heteroaromatic ring, it may contain one or more substituents at any position. Specific examples of the substituents include a halogen atom (e.g., fluorine, chlorine, bromine), an alkyl group having from 1 to 18 carbon atoms (e.g., methyl, ethyl, propyl, butyl, dodecyl, octadecyl, isopropyl, isobutyl), a trifluoromethyl group, a nitro group, an amino group, a cyano group, and an alkoxy group having from 1 to 8 carbon atoms (e.g., methoxy, ethoxy, butoxy).

Y is preferably —$CONR^1R^2$ or —$COOR^2$.

$R^1$ represents a hydrogen atom, an alkyl group having from 1 to 8 carbon atoms (e.g., methyl, ethyl, n-propyl, i-propyl, n-butyl, i-butyl, t-butyl, pentyl, hexyl, isoamyl, isohexyl, neopentyl), or an aryl group having from 6 to 14 carbon atoms (e.g., phenyl, naphthyl, anthryl, biphenyl).

Y is more preferably —$CONHR^2$ or —$COOR^2$.

$R^2$ represents a group represented by the following formula (II):

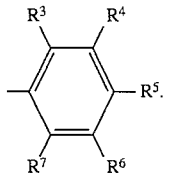

(II)

In formula (II), $R^3$, $R^4$, $R^5$, $R^6$ and $R^7$ ($R^3$ to $R^7$) are the same or different. At least one of $R^3$ to $R^7$ is a group selected from —$CO_2R^8$, —$CONR^9R^{10}$, —$SO_2R^8$, —$SO_3H$, —$SO_2NR^9R^{10}$, —$NR^9COR^{11}$ and —$NR^9SO_2R^{11}$, preferably a group selected from —$CO_2R^8$ and —$CONR^9R^{10}$, and more preferably —$CO_2R^8$. Examples of $R^3$ to $R^7$ other than those represented by the above-cited formulae include a hydrogen atom, an alkyl group having from 1 to 12 carbon atoms (e.g., methyl, ethyl, n-propyl, i-propyl, n-butyl, i-butyl, t-butyl, pentyl, hexyl, isoamyl isohexyl, neopentyl), an alkoxy group having from 1 to 12 carbon atoms (e.g., methoxy, ethoxy, n-propoxy, i-propoxy, n-butoxy, i-butoxy, t-butoxy), a hydroxyl group, a cyano group, a nitro group, a halogen atom (e.g., fluorine, chlorine, bromine), a trifluoromethyl group, an amino group, a carboxyl group, an alkylcarbonyl group having from 2 to 13 carbon atoms (e.g., methylcarbonyl, ethylcarbonyl, propylcarbonyl, butylcarbonyl) and an arylcarbonyl group having from 7 to 15 carbon atoms (e.g., phenylcarbonyl, naphthylcarbonyl, biphenylcarbonyl, anthrylcarbonyl). Preferably, such groups are each a hydrogen atom, an alkyl group having from 1 to 4 carbon atoms, an alkoxy group having from 1 to 4 carbon atoms, a halogen atom or a cyano group.

$R^8$ preferably represents a substituted or unsubstituted straight-chain or branched alkyl group having from 1 to 12 carbon atoms (e.g., methyl, ethyl, n-propyl, i-propyl, n-butyl, i-butyl, t-butyl), a substituted or unsubstituted aryl group having from 6 to 14 carbon atoms (e.g., phenyl, naphthyl, anthryl, biphenyl) or a heteroaromatic ring group (e.g., indolyl, carbazolyl, benzocarbazolyl, dibenzofuranyl), preferably a straight-chain or branched alkyl group having from 1 to 12 carbon atoms, and more preferably a straight-chain or branched alkyl group having from 3 to 10 carbon atoms.

$R^9$, $R^{10}$ and $R^{11}$ each independently represents a hydrogen atom, an alkyl group having from 1 to 12 carbon atoms (e.g., methyl, ethyl, n-propyl, i-propyl, n-butyl, i-butyl, t-butyl) or an aryl group having from 6 to 14 carbon atoms (e.g., phenyl, naphthyl, anthryl, biphenyl).

Specific examples of the disazo compounds according to the present invention are illustrated below. However, the invention should not be construed as being limited to the compounds illustrated below.

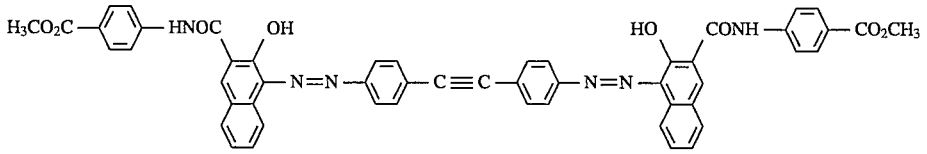
No. 1
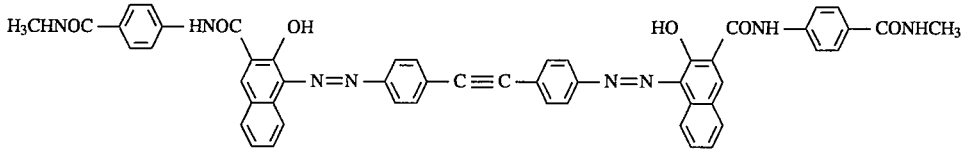
No. 2
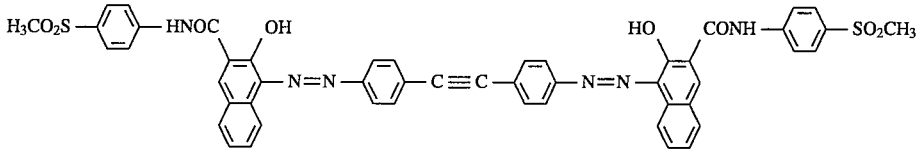
No. 3
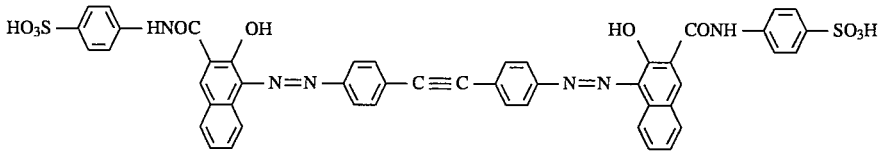
No. 4
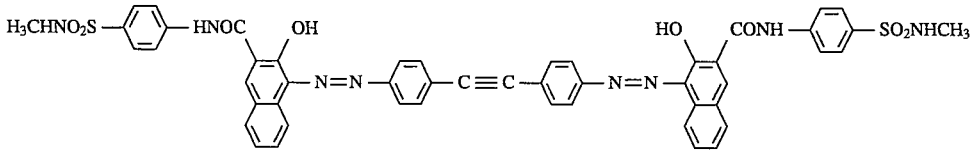
No. 5
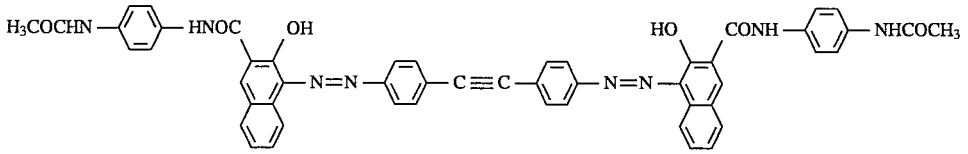
No. 6
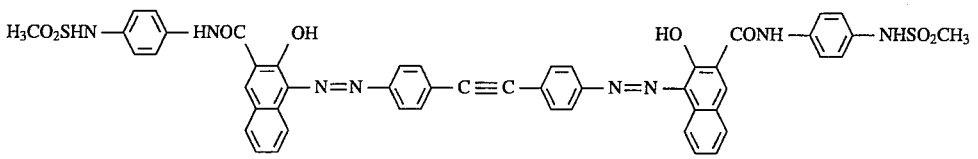
No. 7
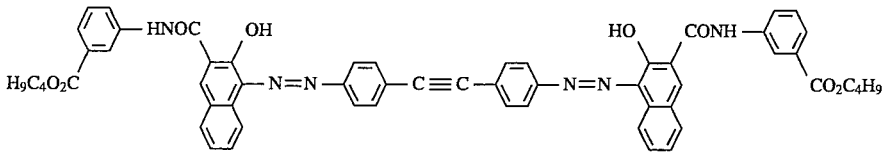
No. 8
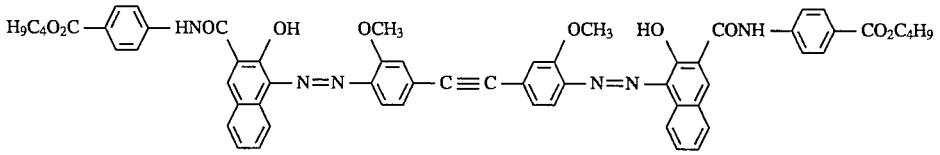
No. 9
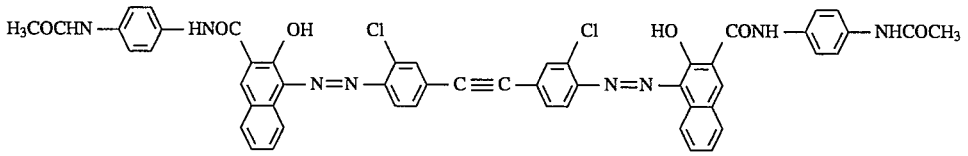
No. 10

-continued
No. 11
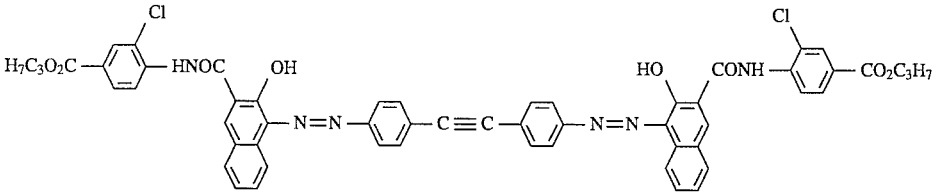
No. 12
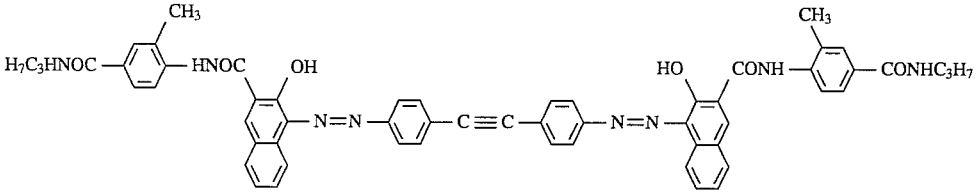
No. 13
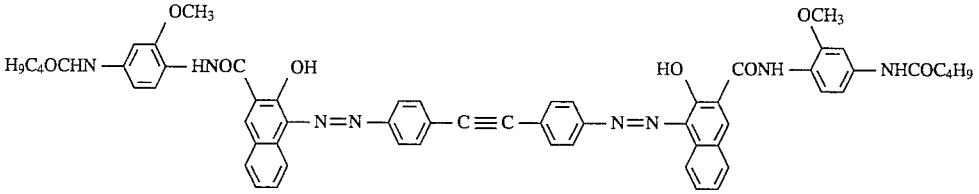
No. 14
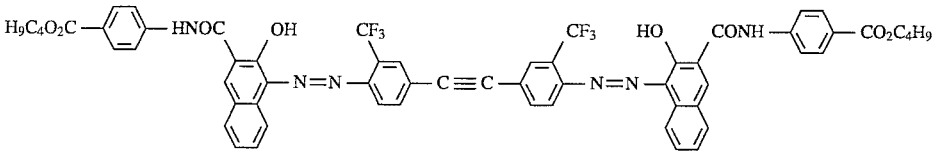
No. 15
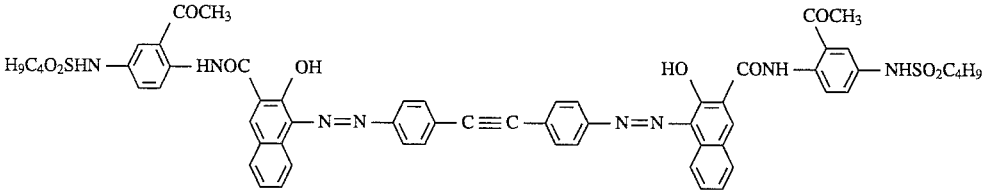
No. 16
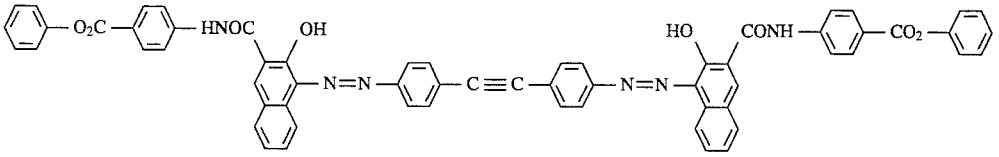
No. 17
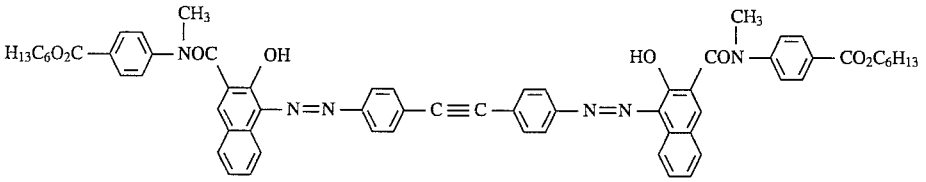
No. 18
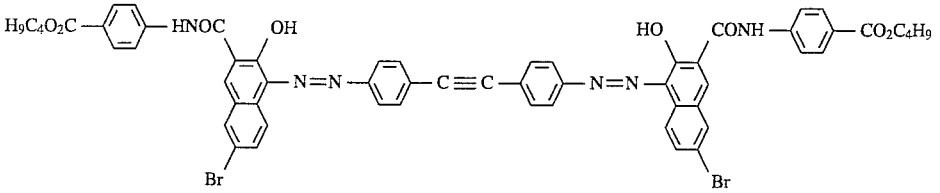
No. 19
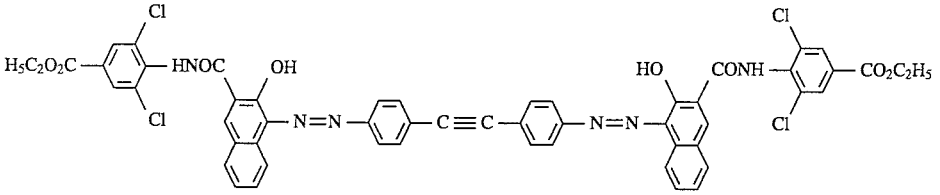

-continued
No. 20
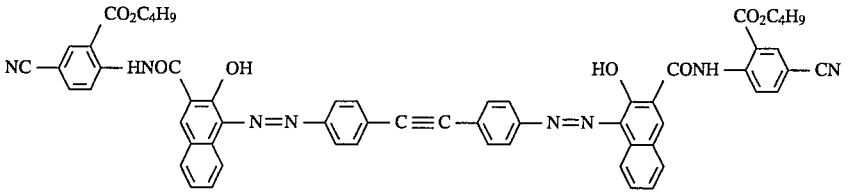
No. 21
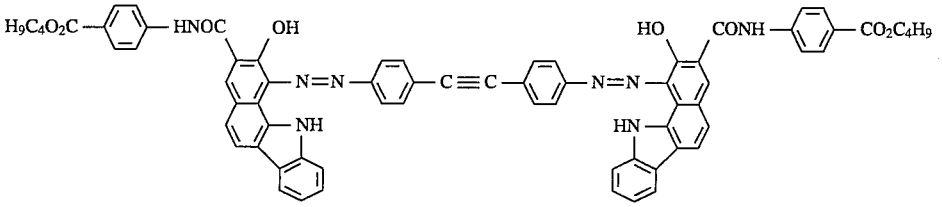
No. 22
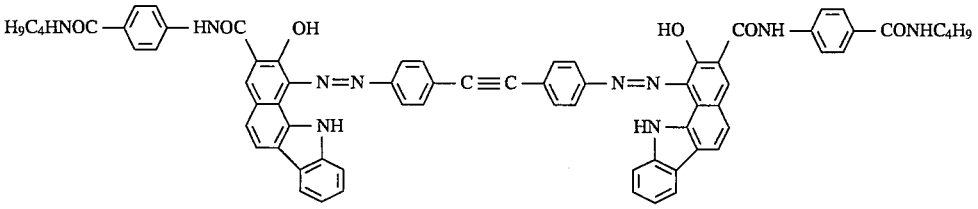
No. 23
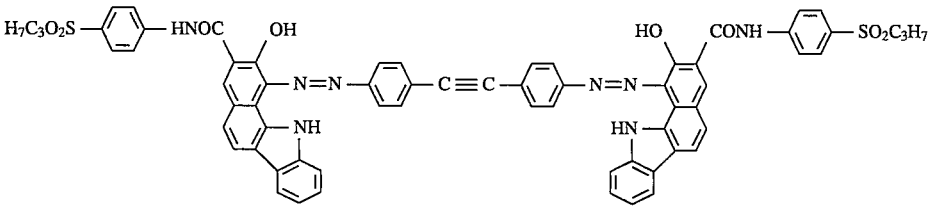
No. 24
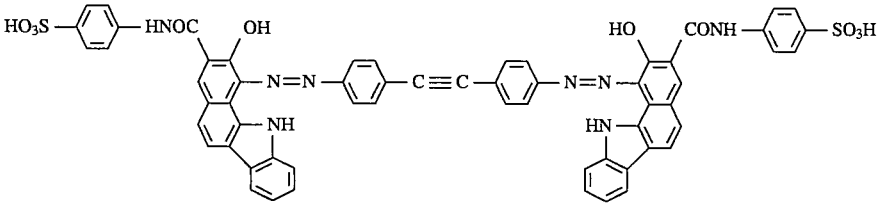
No. 25
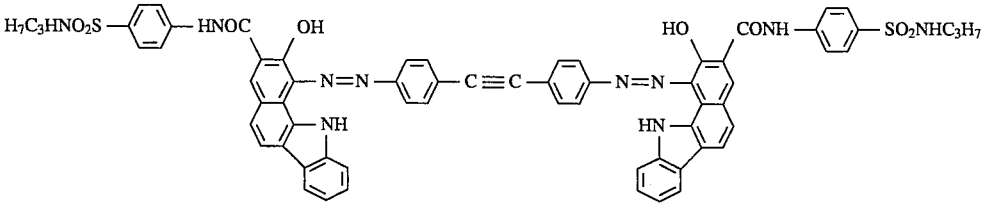
No. 26
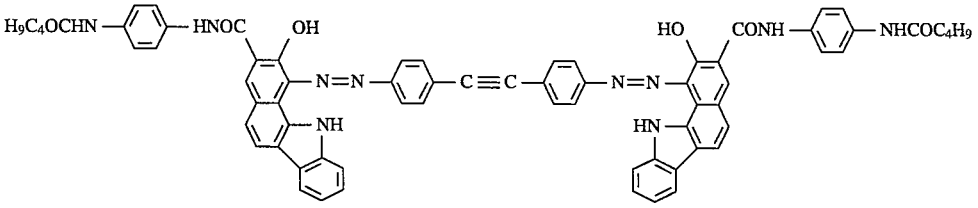

-continued
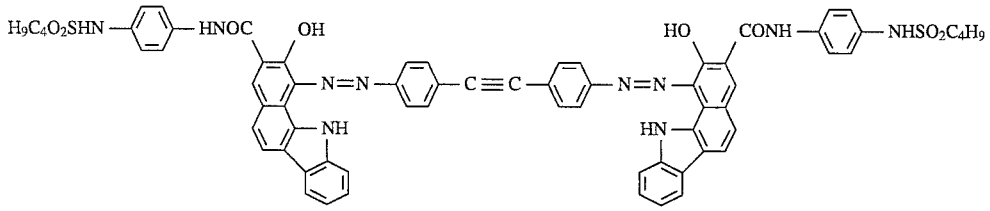
No. 27
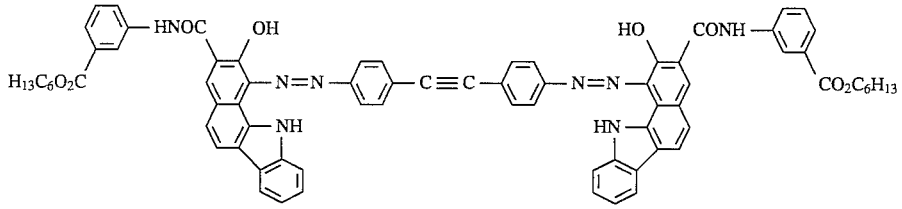
No. 28
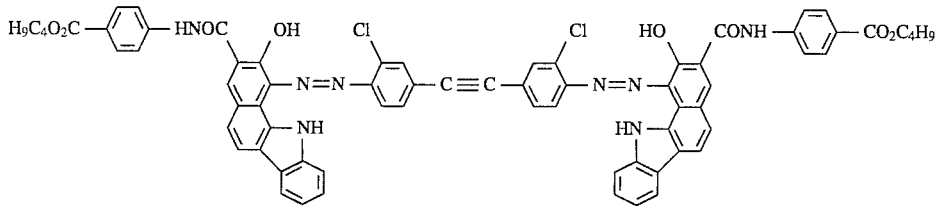
No. 29
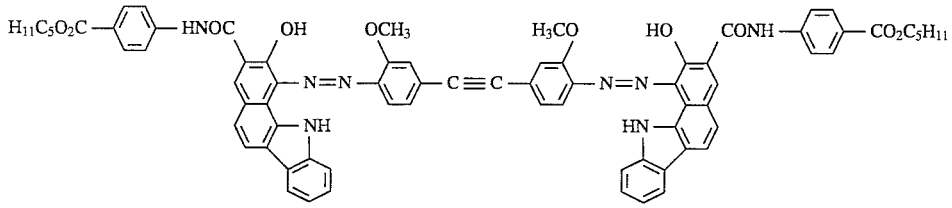
No. 30
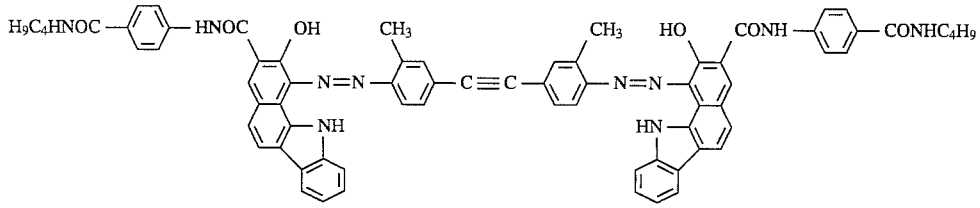
No. 31
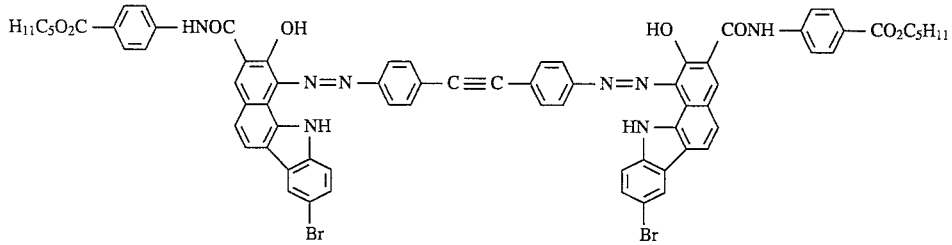
No. 32
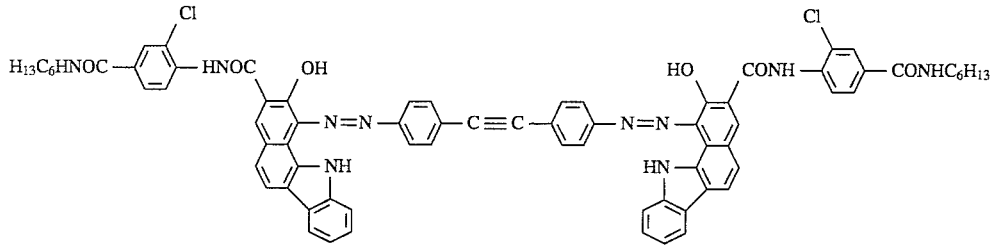
No. 33

-continued
No. 34
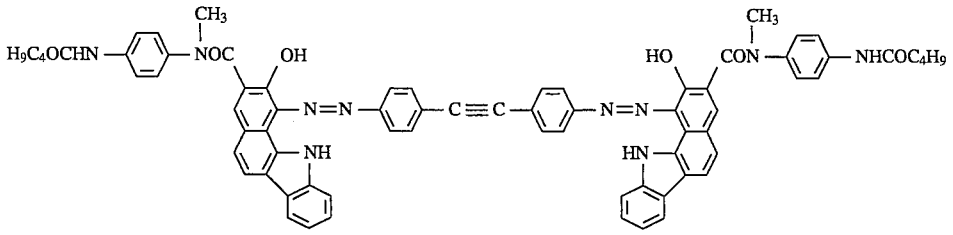
No. 35
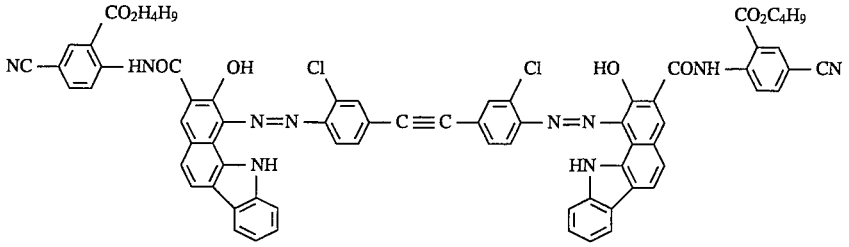
No. 36
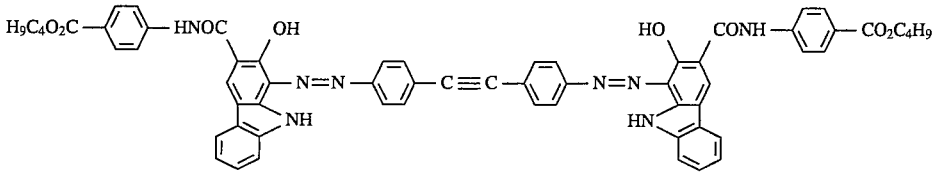
No. 37
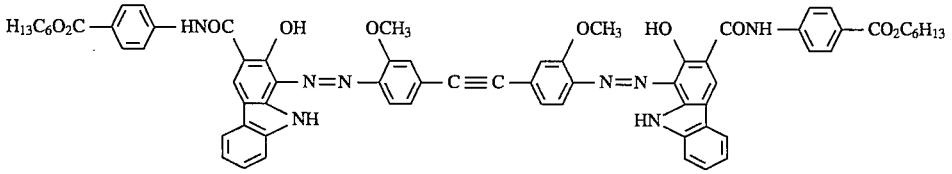
No. 38
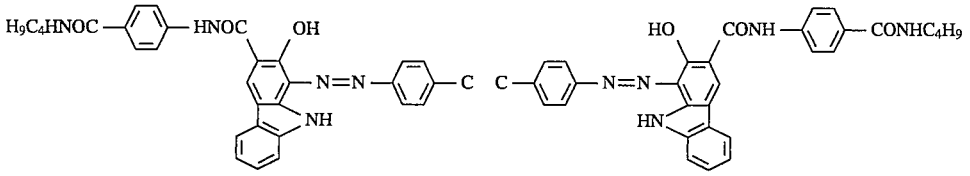
No. 39
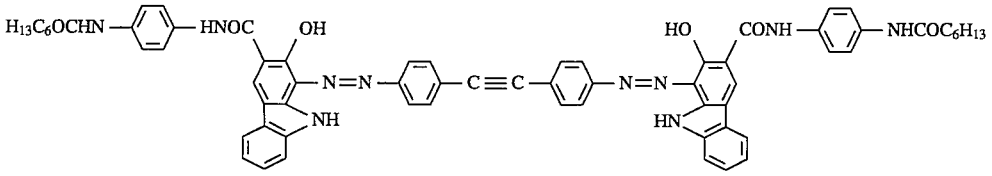
No. 40
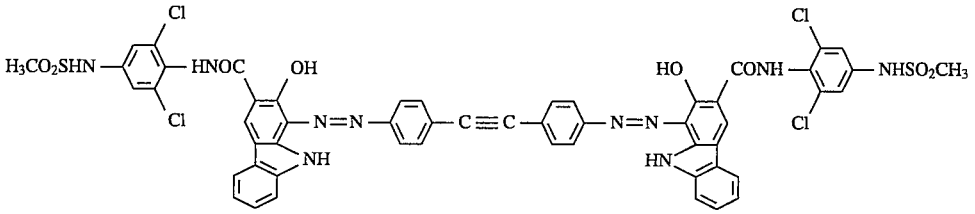
No. 41
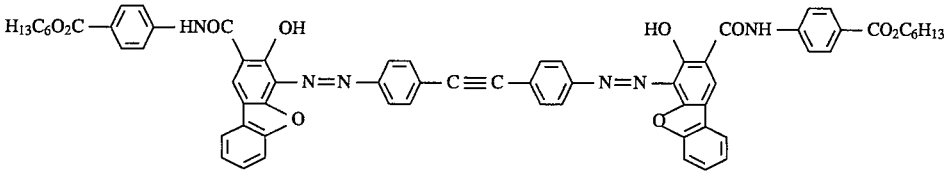

-continued
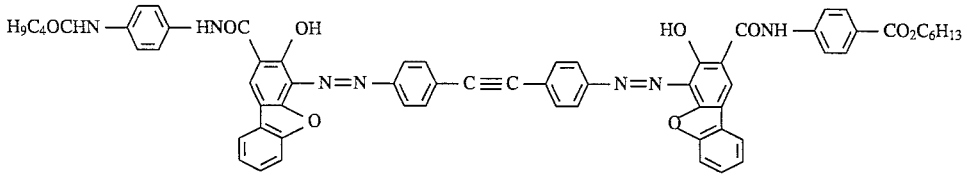
No. 42
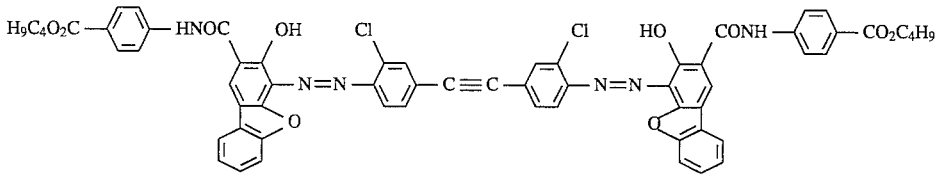
No. 43
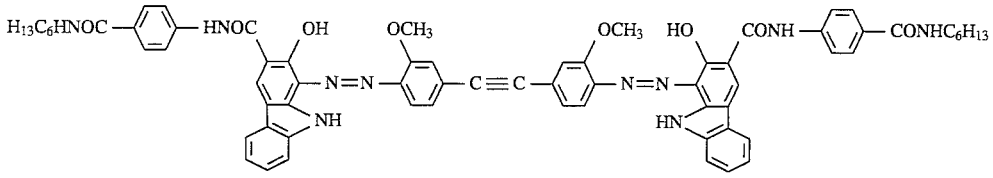
No. 44
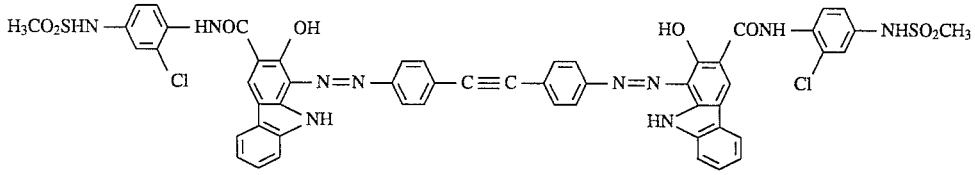
No. 45
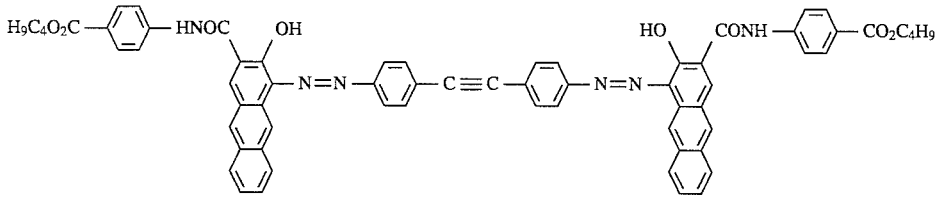
No. 46
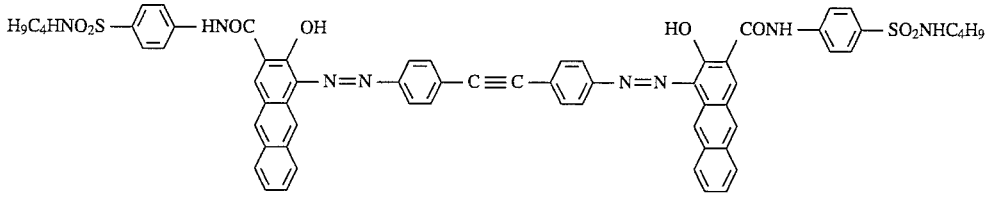
No. 47
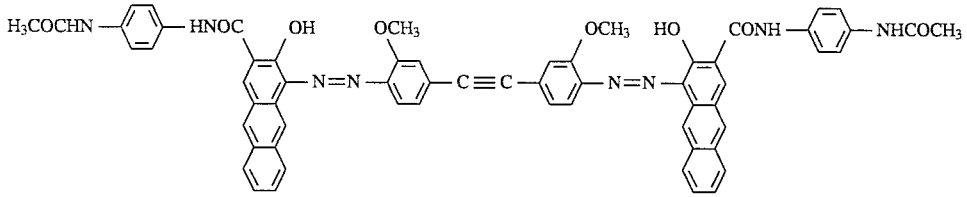
No. 48
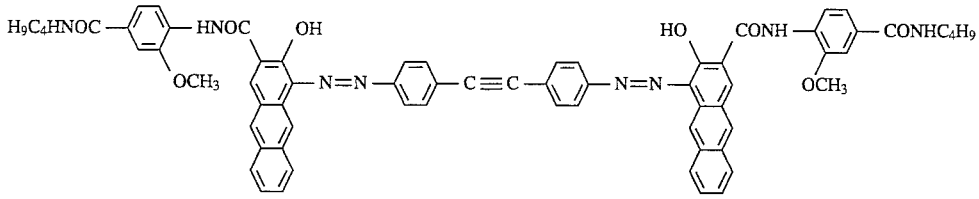
No. 49

-continued
No. 50
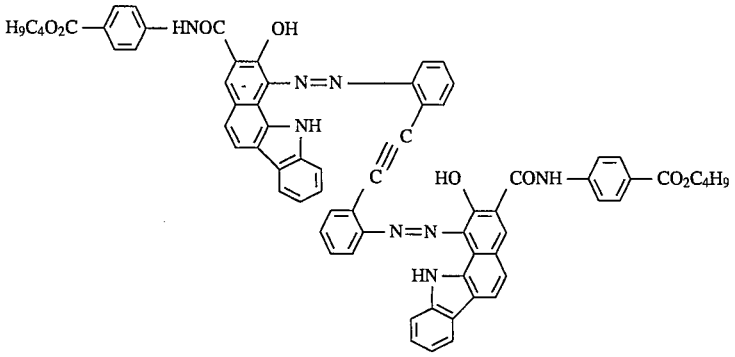
No. 51
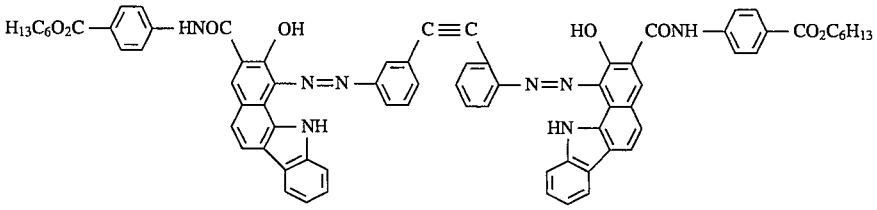
No. 52
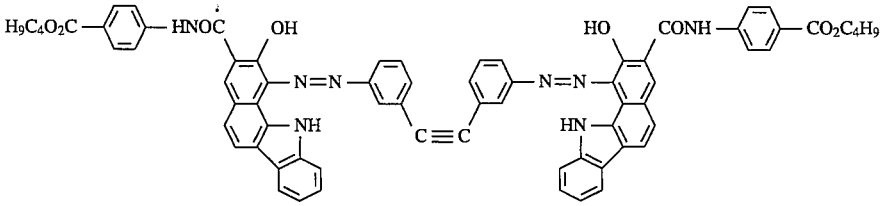
No. 53
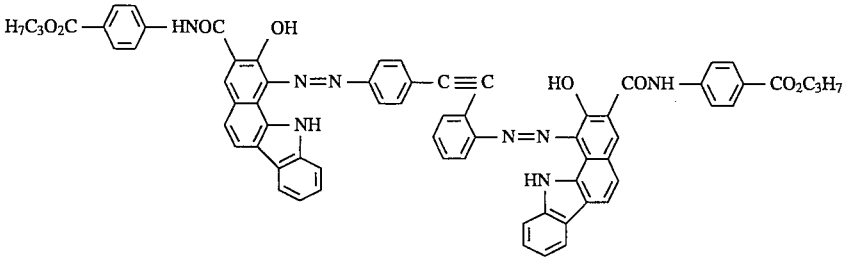
No. 54
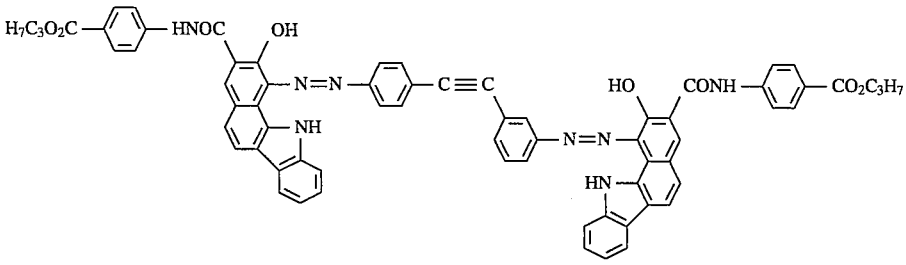
No. 55
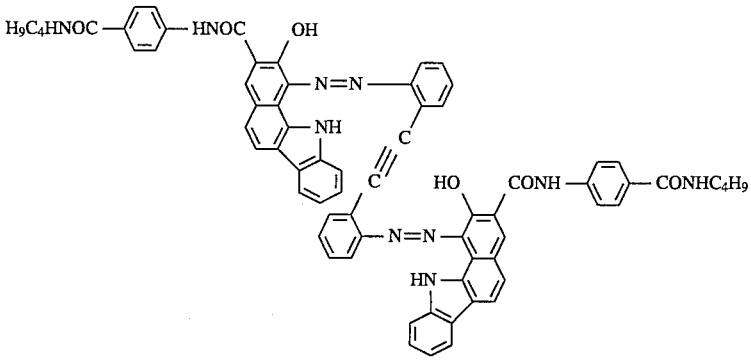

-continued
No. 56
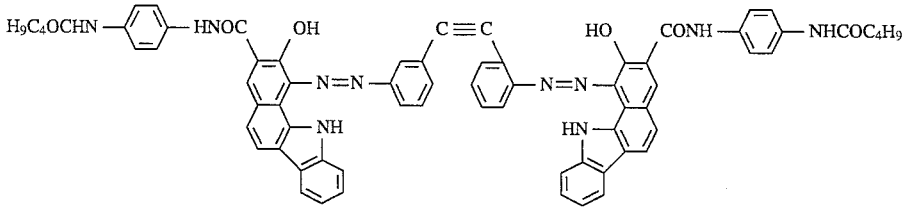
No. 57
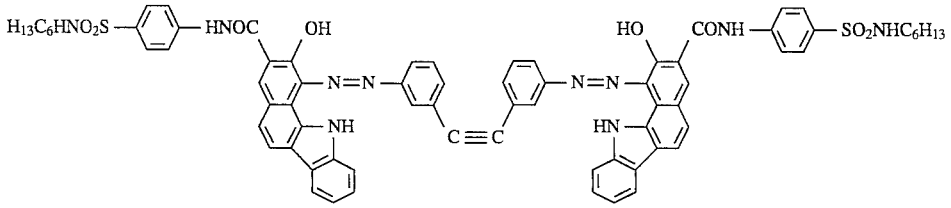
No. 58
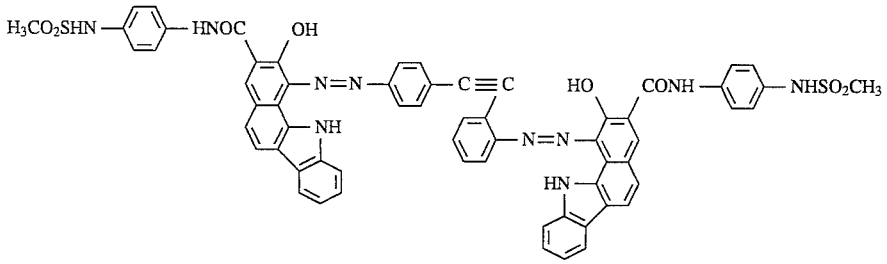
No. 59
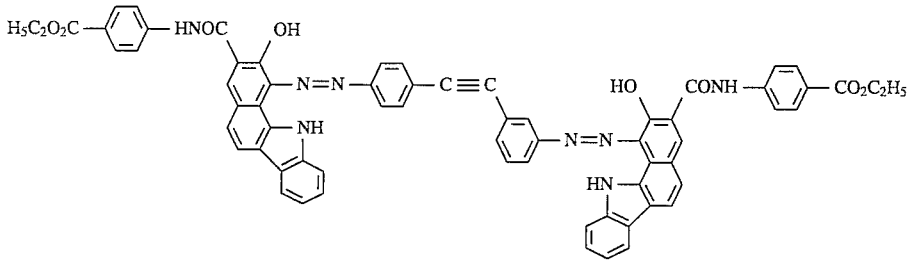
No. 60
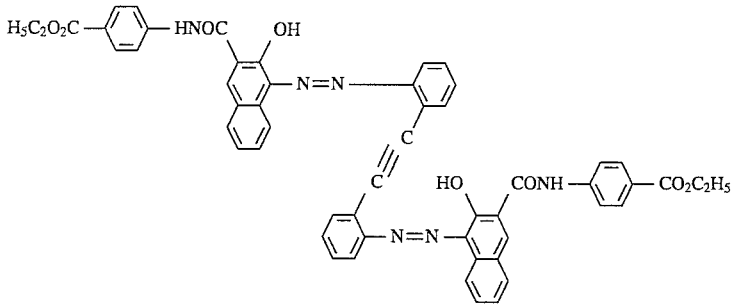
No. 61
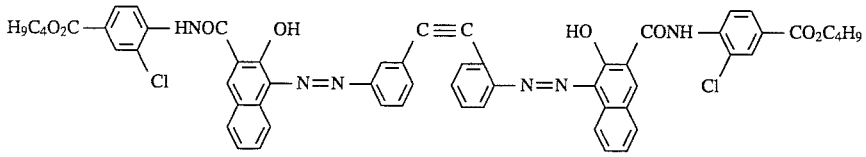
No. 62
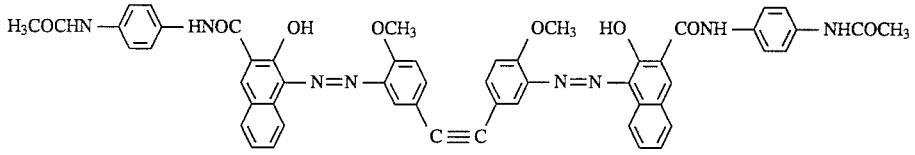

-continued
No. 63
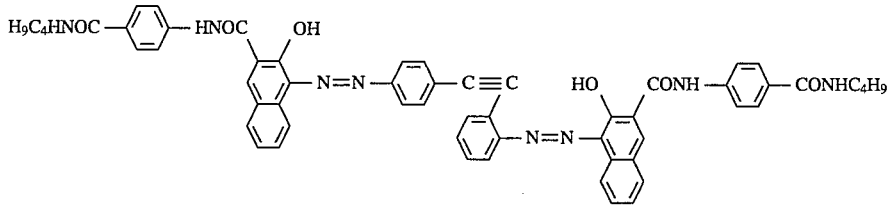
No. 64
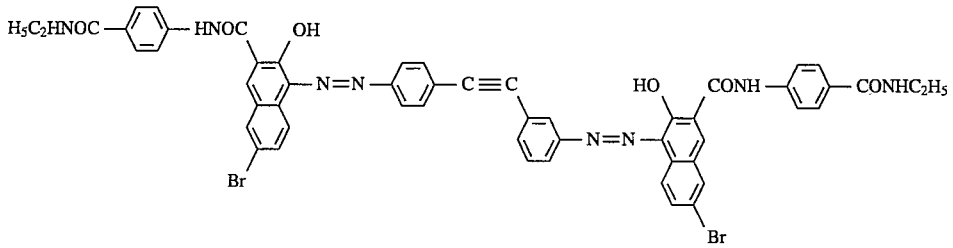
No. 65
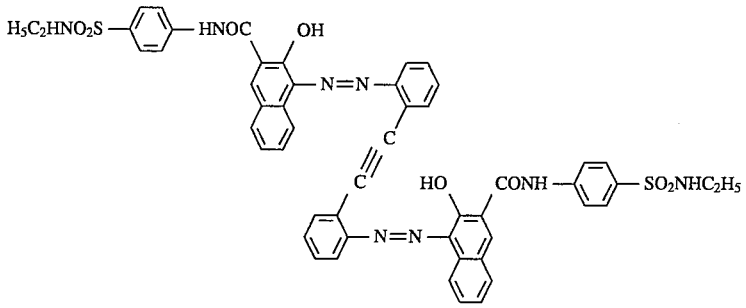
No. 66
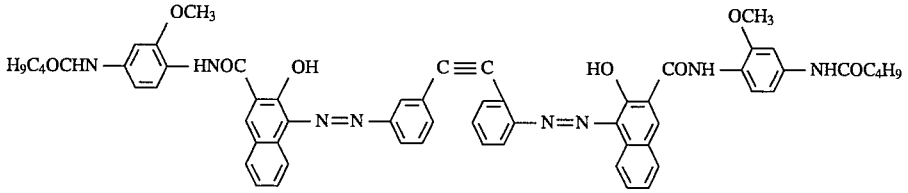
No. 67
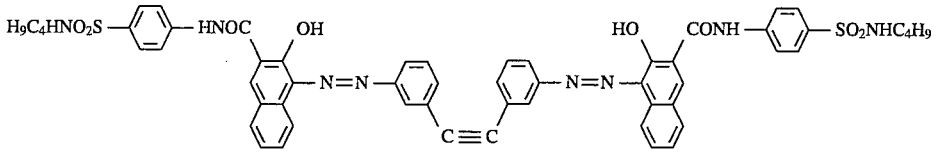
No. 68
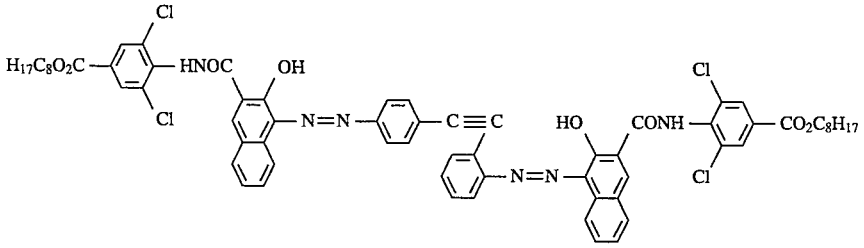
No. 69
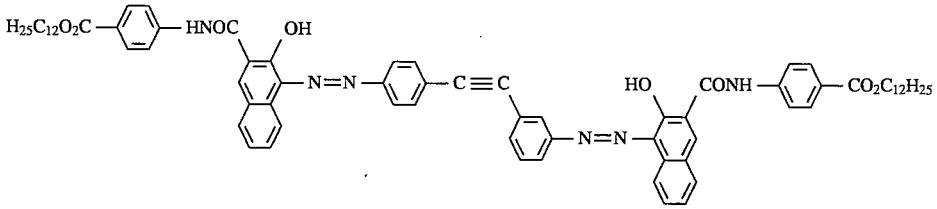

-continued
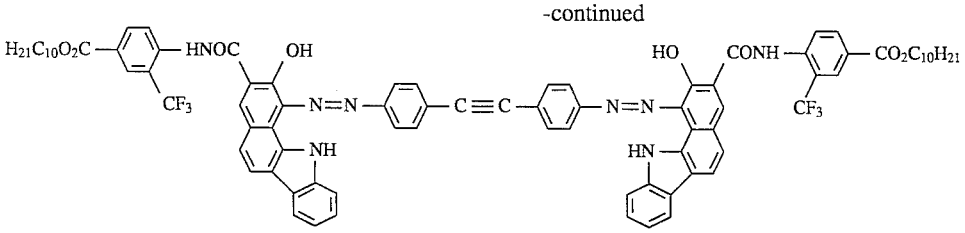
No. 70
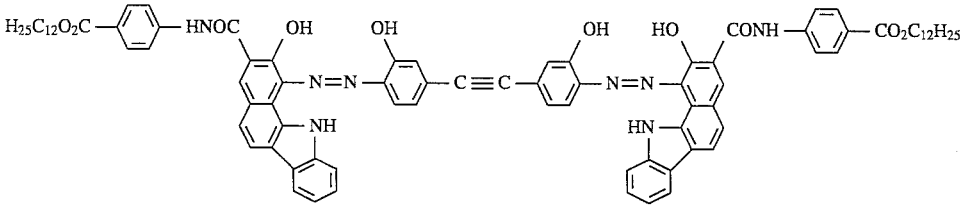
No. 71
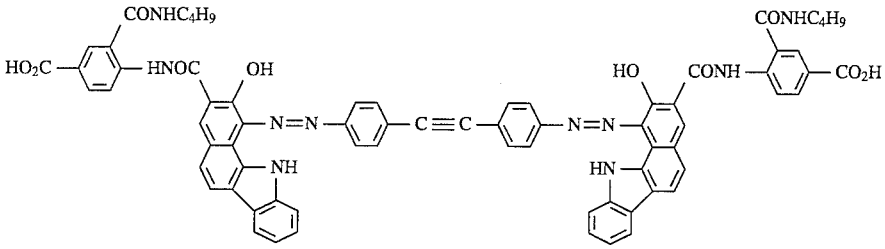
No. 72
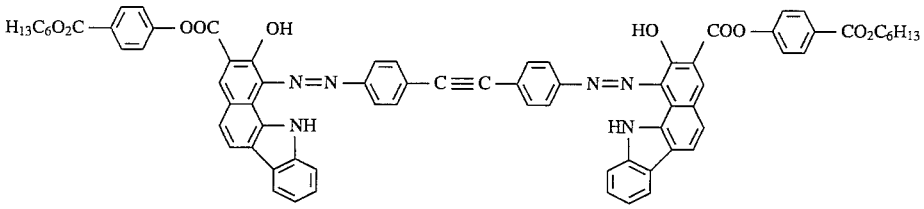
No. 73
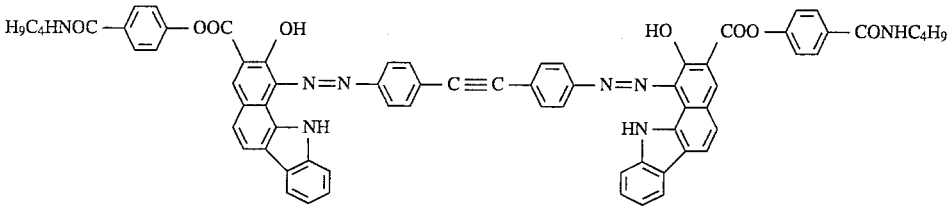
No. 74
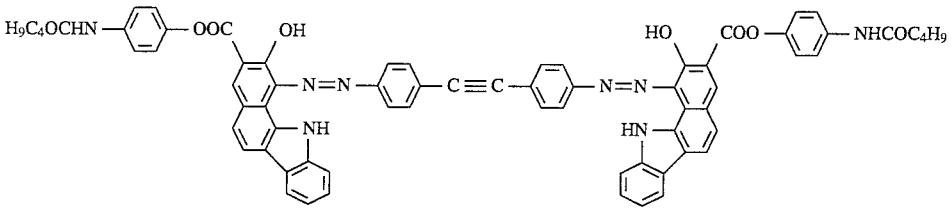
No. 75
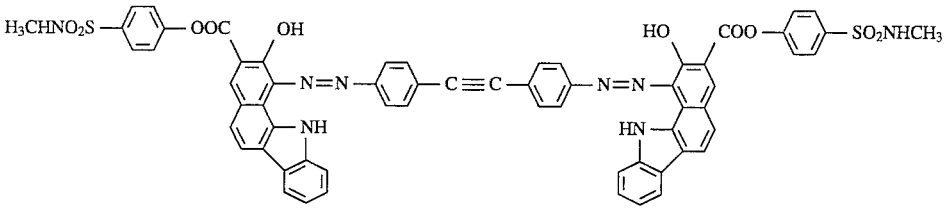
No. 76

-continued

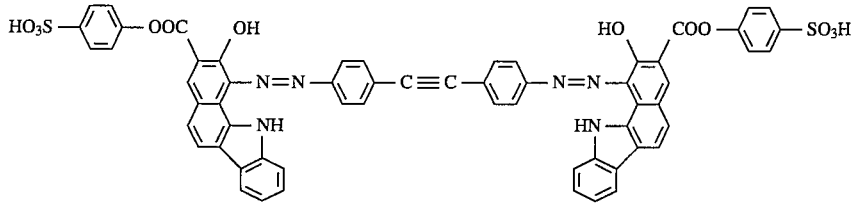

No. 77

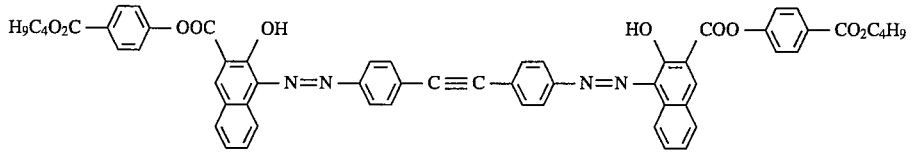

No. 78

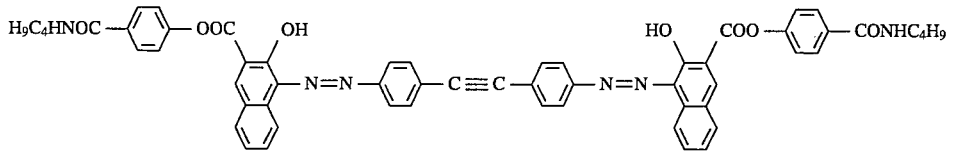

No. 79

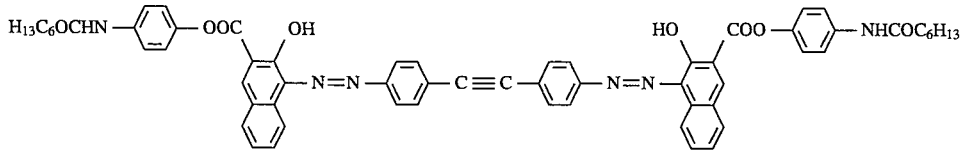

No. 80

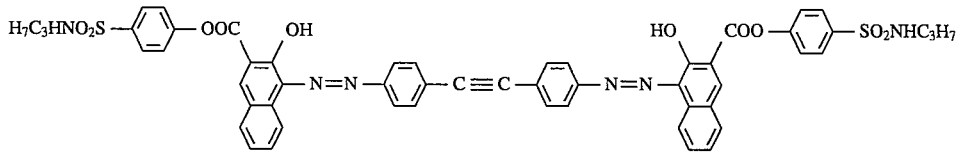

No. 81

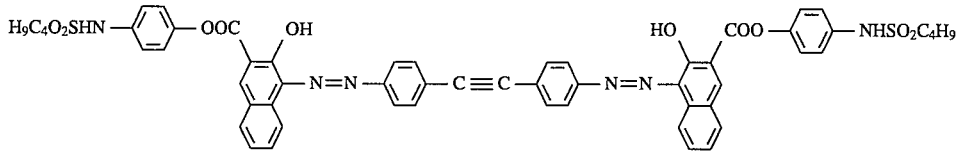

No. 82

The novel disazo compounds represented by formula (I) of the present invention can be synthesized with ease using a method as described below. Specifically, a diamino compound represented by the following formula (III) is tetrazotated in a conventional manner, and then undergoes the coupling reaction with a coupler corresponding thereto in the presence of an alkali; or the tetrazonium salt formed is isolated in the form of borofluoride or as the double salt formed using zinc chloride, and then undergoes the coupling reaction with a coupler in a solvent, such as N,N-dimethylformamide and dimethylsulfoxide, in the presence of an alkali:

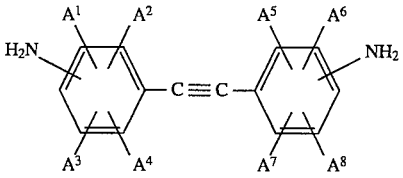

(III)

wherein $A^1$, $A^2$, $A^3$, $A^4$, $A^5$, $A^6$, $A^7$ and $A^8$ have the same meanings as those in formula (I) illustrated hereinbefore, respectively.

Synthesis of Compound No. 1 (exemplified above)

The diamino compound represented by the following formula (a) in an amount of 2.08 g (0.01 mol) is added to the dilute hydrochloric acid prepared from 25 ml of conc. HCl and 30 ml of water, and stirred for 30 minutes on a 60° C. water bath. Then, the resulting solution is cooled to 0° C., and thereinto is dropwise added a solution containing 1.38 g of sodium nitrite in 10 ml of water over a period of about 20 minutes. Thereafter, the resulting mixture is stirred for one hour as it is kept at 0° C. A small amount of the reacting species remaining unreacted is filtered out, and the filtrate is dropwise added into a coupler solution prepared in a separate vessel, which consists of 6.42 g (0.02 mol) of a coupler represented by formula (b) illustrated below, 3.28 g of sodium acetate, 10 ml of water and 300 ml of DMF, as the resulting mixture is stirred and cooled in an ice bath. Then, the reaction mixture is stirred at room temperature for 2 hours to produce crystals. These crystals are filtered off, and purified by repetition of alternate washing with water and acetone. Thus, 6.5 g of the intended disazo compound (Compound No. 1) is obtained as black powder. Yield: 74%; decomposition temperature: 280° C. or more.

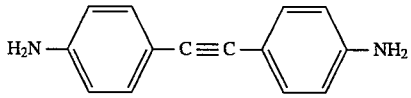

(a)

-continued (b)

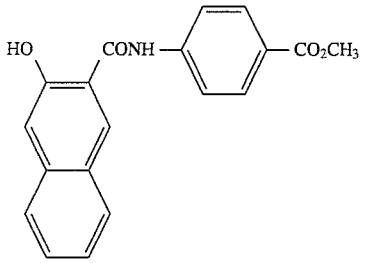

Elemental Analysis (as $C_{52}H_{36}N_6O_8$): Calcd.; C 71.55%, H 4.16%, N 9.63%. Found; C 71.52%, H 4.17%, N 9.61%.

The electrophotographic photosensitive material according to the present invention has an electrophotographic photosensitive layer containing at least one disazo compound represented by formula (I). Hitherto, various types of electrophotographic photosensitive materials have been known. The electrophotographic photosensitive material of the present invention, although it may be a photosensitive material of any conventional type, generally has a structure chosen from those of the types (1), (2) and (3) described below:

(1) an electrophotographic photosensitive material comprising a conductive support having thereon an electrophotographic photosensitive layer containing a disazo compound dispersed in a binder or charge carrier transporting medium.

(2) an electrophotographic photosensitive material comprising a conductive support having thereon a charge carrier generating layer containing a disazo compound as a main component, and further thereon a charge carrier transporting layer.

(3) an electrophotographic photosensitive material comprising a conductive support having thereon a charge carrier transporting layer, and further thereon a charge carrier generating layer containing a disazo compound as a main component.

The disazo compounds represented by formula (I) according to the present invention can generate charge carriers at very high efficiency upon absorption of light. The charge carriers generated are transported by a charge carrier transporting compound.

An electrophotographic photosensitive material having the structure of type (1) can be prepared by a process comprising the steps of (i) dispersing fine particles of the disazo compound into a binder solution or a solution in which a charge carrier transporting compound and a binder are dissolved, (ii) coating the thus obtained dispersion on a conductive support, and (iii) drying the dispersion coated. In this structure of type (1), the thickness of the electrophotographic photosensitive layer is preferably from 3 to 30 μm, more preferably from 5 to 20 μm.

An electrophotographic photosensitive material having the structure of type (2) can be prepared by a process comprising the steps of (i) coating the disazo compound by vacuum evaporation or coating and subsequently drying a dispersion prepared by dispersing fine particles of the disazo compound into an appropriate solvent in which a binder resin is dissolved on a conductive support to form a charge carrier generating layer, optionally followed by subjecting the surface thereof to a finishing treatment, such as buff polishing, or by adjusting the layer thickness thereof, and (ii) coating on the thus formed layer a solution containing a charge carrier transporting material and a binder resin, followed by a drying operation. In this structure of type (2), the thickness of the charge carrier generating layer is preferably from 0.01 to 4 μm, more preferably from 0.1 to 2 μm, and that of the charge carrier transporting layer is preferably 3 to 30 μm, more preferably from 5 to 20 μm.

An electrophotographic photosensitive material having the structure of type (3) can be prepared by reversing the coating order adopted in the preparation of the electrophotographic photosensitive material of type (2).

The disazo compounds used in the photosensitive materials of types (1), (2) and (3) are prepared to fine particles having a diameter of from 0.1 to 2 μm, preferably from 0.3 to 2 μm, by a dispersing machine such as a ball mill, a sand mill and a vibrating mill, and are dispersed in the solution.

When the disazo compound is used in the electrophotographic photosensitive material of type (1) in a too small amount, the photosensitivity obtained is too low; while when it is used therein in a too large amount, it causes deterioration of chargeability and film strength of the electrophotographic photosensitive layer. The amount of the disazo compound in the electrophotographic photosensitive layer is from 0.01 to 2 parts by weight, preferably from 0.05 to 1 parts by weight, based on 1 part by weight of the binder. In addition, the amount of the charge carrier transporting compound is from 0.1 to 2 parts by weight, preferably from 0.3 to 1.5 parts by weight, based on 1 part by weight of the binder. When the charge carrier transporting compound itself can be used as a binder, the amount of the disazo compound used is preferably from 0.01 to 0.5 parts by weight based on 1 part by weight of the charge carrier transporting compound.

In forming a disazo compound-containing layer as the layer containing a charge carrier generating compound for the preparation of the electrophotographic photosensitive materials of types (2) and (3) each, the amount of the disazo compound used is preferably 0.1 part by weight or more based on 1 part by weight of the binder. When the amount of the disazo compound used is less than 0.1 part by weight, sufficient photosensitivity cannot be obtained. Also, any binder may not be used therein. The amount of the charge carrier transporting compound in the charge carrier transporting layer used is from 0.2 to 2 parts by weight, preferably 0.3 to 1.5 parts by weight, based on 1 part by weight of the binder. When the charge carrier transporting compound capable of functioning as a binder by itself is used, any other binders may not be used therein.

Specific examples of a conductive support which can be used in the present electrophotographic photosensitive materials include a metal plate (e.g., an aluminum plate, a copper plate, a zinc plate), sheets or films of plastics such as polyester, wherein a conductive material (e.g., aluminum, indium oxide, tin oxide, copper iodide) is evaporated or coated by a dispersion on the sheets or films; and papers subjected to a conductive treatment with an inorganic salt (e.g., sodium chloride, potassium chloride) or with an organic quaternary ammonium salt.

When the binder is used, the binder used is preferably a hydrophobic, highly dielectric, electroinsulating film-forming polymer having a high molecular weight. Specific examples of such a polymer include polycarbonate, polyester, polyether carbonate, polysulfone, a methacrylic resin, an acrylic resin, polyvinyl chloride, polyvinylidene chloride, polystyrene, polyvinyl acetate, a styrene-butadiene copolymer, a vinylidene chloride-acrylonitrile copolymer, a vinyl chloride-vinyl acetate copolymer, a vinyl chloride-vinyl acetate-maleic anhydride terpolymer, a silicone resin, a silicone-alkyd resin, a phenol-formaldehyde resin, a styrene-alkyd resin, a styrene-maleic anhydride copolymer, a phenoxy resin, a polyvinyl butyral resin and poly-N-vinyl-carbazole. It is needless to say that binders usable in the present invention should not be construed as being limited to the above-cited ones.

Those binder resins can be used alone or as a mixture of two or more thereof.

In the electrophotographic photosensitive materials according to the present invention, a plasticizer can be used together with the binder.

Specific examples of the plasticizer which can be used herein include biphenyl, biphenyl chloride, o-terphenyl, p-terphenyl, dibutyl phthalate, dimethylglycol phthalate, dioctyl phthalate, triphenyl phosphate, chlorinated paraffins, and dilaurylthiodipropionate.

In producing an electrophotographic photosensitive material according to the present invention, additives such as a sensitizer may be used in its photosensitive layer.

Specific examples of the sensitizer include triarylmethane dyes (e.g., Brilliant Green, Victoria Blue B, Methyl Violet, Crystal Violet, Acid Violet 6B), xanthene dyes (e.g., Rhodamine B, Rhodamine 6G, Rhodamine G Extra, Eosine S, erythrosine, Rose Bengale, fluorecein), thiazine dyes (e.g., Methylene Blue), anthrazone dyes (e.g., C.I. Basic Violet 7 (C.I.48020)), cyanine dyes, and pyrylium dyes (e.g., 2,6-diphenyl-4-(N,N-dimethylaminophenyl)thiapyrylium perchlorate, benzopyrylium salts disclosed in JP-B-48-25658).

Further, additives such as silicone oils, fluorine-containing surfactants can be used for the purpose of improving surface properties of the electrophotographic photosensitive materials.

Charge carrier transporting materials which can be used in a charge carrier transporting layer according to the present invention are classified into two kinds, namely compounds of a kind which transport electrons and those of a kind which transport positive holes. Both of them can be used in the electrophotographic photosensitive materials of the present invention.

Examples of the electron transporting compounds include compounds containing an electron attractive group such as 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazole, chrolanil, 2,3-dichloro-5,6-dicyanobenzoquinone, 2,4,7-trinitro-9,10-phenanthrenequinone, tetrachlorophthalic anhydride, tetracyanoethylene, and tetracyanoquinodimethane.

Examples of the positive-hole transporting compounds include compounds containing an electron donative group having a high molecular weight such as:

(a) polyvinylcarbazole and derivatives thereof disclosed in JP-B-34-10966;

(b) vinyl polymers such as polyvinylpyrene, polyvinylanthracene, poly-2-vinyl-4-(4'-dimethylaminophenyl)-5-phenyloxazole and poly-3-vinyl-N-ethylcarbazole disclosed in JP-B-43-18674 and JP-B-43-19192;

(c) polymers such as polyacenaphthylene, polyindene and acenaphthylene-styrene copolymers disclosed in JP-B-43-19193;

(d) condensation resins such as pyrene-formaldehyde resin, bromopyrene-formaldehyde resin and ethylcarbazole-formaldehyde resin disclosed in JP-B-56-13940; and (e) triphenylmethane polymers of various types disclosed in JP-A-56-90883 and JP-A-56-161550;

and ones having a low molecular weight such as;

(f) triazole derivatives disclosed in U.S. Pat. No. 3,112,197;

(g) oxadiazole derivatives disclosed in U.S. Pat. No. 3,189,447;

(h) imidazole derivatives disclosed in JP-B-37-16096;

(i) polyarylalkane derivatives disclosed in U.S. Pat. Nos. 3,615,402, 3,820,989 and 3,542,544, JP-B-45-555, JP-B-51-10983, JP-A-51-93224, JP-A-55-108667, JP-A-55-156953 and JP-A-56-36656;

(j) pyrazoline derivatives and pyrazolone derivatives disclosed in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637 and JP-A-55-74546;

(k) phenylenediamine derivatives disclosed in U.S. Pat. No. 3,615,404, JP-B-51-10105, JP-B-46-3712, JP-B-47-28336, JP-A-54-83435, JP-A-54-110836 and JP-A-54-119925;

(l) arylamine derivatives disclosed in U.S. Pat. Nos. 3,567,450, 3,180,703, 3,240,597, 3,658,520, 4,232,103, 4,175,961 and 4,012,376, West German Patent (DAS) 1110518, JP-B-49-35702, JP-B-39-27577, JP-A-55-144250, JP-A-56-119132 and JP-A-56-22437;

(m) amino-substituted chalcone derivatives disclosed in U.S. Pat. No. 3,526,501;

(n) N,N-bicarbazyl derivatives disclosed in U.S. Pat. No. 3,542,546;

(o) oxazole derivatives disclosed in U.S. Pat. No. 3,257,203;

(p) styrylanthracene derivatives disclosed in JP-A-56-46234;

(q) fluorenone derivatives disclosed in JP-A-54-110837;

(r) hydrazone derivatives disclosed in U.S. Pat. No. 3,717,462, U.S. Pat. No. 4,150,987 (corresponding to JP-A-54-59143), JP-A-55-52063, JP-A-55-52064, JP-A-55-46760, JP-A-55-85495, JP-A-57-11350, JP-A-57-148749 and JP-A-57-104144;

(s) benzidine derivatives disclosed in U.S. Pat. Nos. 4,047,948, 4,047,949, 4,265,990, 4,273,846, 4,299,897 and 4,306,008; and (t) stilbene derivatives disclosed in JP-A-58-190953, JP-A-59-95540, JP-A-59-97148, JP-A-59-195658 and JP-A-62-36674.

The charge carrier transporting compounds which can be used in the present invention are not limited to the above-cited compounds classified into the groups from (a) to (t), but include all of the hitherto known charge carrier transporting compounds.

As for the proportion of the charge carrier transporting material to the binder resin, the charge carrier transporting material is used in such an amount as not to cause precipitation thereof from the binder or, in other words, as to retain its compatibility with the binder resin. However, the lowering of sensitivity is caused by using the charge carrier transporting material in a small proportion. Therefore, the amount of the charge carrier transporting material used is from 0.05 to 3 parts by weight, preferably 0.1 to 1.5 parts by weight, based on 1 part by weight of the binder resin. On the other hand, the charge generating material causes deterioration of charge retention characteristics when it is used in a too large amount, while it brings about the lowering of sensitivity when it is used in a too small amount. Thus, the amount of the charge generating material in the photosensitive material is from 0.01 to 2 parts by weight, preferably from 0.05 to 1 part by weight, based on 1 part by weight of the binder resin.

In producing the present electrophotographic photosensitive materials, additives such as a sensitizer may be used in the charge generating layer and the charge carrier transporting layer. Also, the charge carrier transporting compounds may be added to the charge generating layer.

Suitable examples of such a sensitizer include chloranil, tetracyanoethylene, Methyl Violet, Rhodamine B, cyanine dyes, merocyanine dyes, pyrylium dyes and thiapyrylium dyes.

The binder resin, the charge carrier transporting compound and other additives used for forming the photoconductive layer may be added at the same time as or after the dispersion of the charge generating material.

A coating composition containing the ingredients as described above is coated on a substrate using a conventional coating method, such as a spin, blade, knife, reverse roll, dip, rod bar or spray coating method, and then dried to form an electrophotographic photosensitive material. Specific examples of a solvent used for preparing the coating composition include halogenated hydrocarbons (e.g., dichloromethane, dichloroethane, chloroform), alcohols (e.g., methanol, ethanol), ketones (e.g., acetone, methyl ethyl ketone, chlorohexanone), glycol ethers (e.g., ethylene glycol monomethyl ether, 2-methoxyethylacetate, dioxane), and esters (e.g., ethyl acetate, butyl acetate).

In an electrophotographic photosensitive material according to the present invention, an adhesive layer or a barrier layer can be formed between a conductive support and a photosensitive material layer, if desired. For forming such a layer, there can be used not only the polymers usable as the aforementioned resin binder, but also gelatin, casein, polyvinyl alcohol, ethyl cellulose, carboxymethyl cellulose, the vinylidene chloride type polymer latexes disclosed in JP-A-59-84247, and the styrene-butadiene polymer latexes disclosed in JP-A-59-114544, aluminum oxide. The thickness of an adhesive or barrier layer is preferably 1 μm or less.

To the thus obtained photosensitive material, a measure for prevention of interference fringe, which generates when coherent light such as layer is used for exposure, can further be given, if needed. Examples of the method for such a purpose include the method disclosed in JP-A-60-186850, which forms an undercoating layer having a light scattering reflection surface; the method disclosed in JP-A-60-184258, which forms an undercoating layer containing titanium black; the method disclosed in JP-A-58-82249, which absorbs a large portion of the light emitted from a light source in the charge carrier generating layer; the method disclosed in JP-A-61-18963, which prepares the charge carrier transporting layer so as to have a microphase separation structure; the method disclosed in JP-A-60-86550, which incorporates a coherent light absorbing or scattering material into the photoconductive layer; the method disclosed in JP-A-63-106757, which makes dents having a depth of at least one-quarter the wavelength of coherent light in the photosensitive material surface; and the methods disclosed in JP-A-62-172371 and JP-A-62-174771, which form a light scattering layer or a light absorbing layer on the back of a transparent support.

The present electrophotographic photosensitive materials, which are illustrated above in detail, have a feature in that they are generally high in sensitivity and cause a slight change in electrophotographic characteristics upon repeated use.

Further, the present electrophotographic photosensitive materials are suited to photosensitive materials using laser for the exposure since their absorption spectra show a sharp and high absorption band.

The present electrophotographic photosensitive materials can be applied not only to electrophotographic copying machines, but also to various fields, e.g., as photosensitive materials of printers using laser, Braun tube and LED as a light source.

The photoconductive compositions containing the disazo compound according to the present invention can be used as a photoconductive layer for the image pickup tube of a video camera, or as a light-receiving layer (photoconductive layer) of a solid image-pickup element for signal transfer and scanning, which is constituted of one- or two-dimensionally aligned semiconductor circuit and a light receiving layer covering over the whole surface of the circuit. Further, they can be used as a photoconductive layer of solar battery, as described in A. K. Ghosh & Tom Feng, *J. Appl. Phys.* vol. 49(12), p. 5982 (1978).

Furthermore, the disazo compounds according to the present invention can be used as photoconductive colored particles in a photoelectrophoresis system, or as colored particles of a dry or wet electrophotographic developer.

Next, the printing plate for electrophotographic process according to the present invention, which is prepared by subjecting an electrophotographic photosensitive material comprising a conductive support having thereon a photoconductive layer containing at least a charge generating material, a charge transporting material and a binder resin to an imagewise exposure and a development to form a toner image, and by removing a non-image area of the photoconductive layer other than the toner image areas thereof, wherein at least one charge generating material is a disazo compound represented by formula (I) described hereinabove, will be now illustrated below.

In analogy with the original plate, printed circuits can also be formed.

Suitable examples of the conductive support which can be used in the printing plate for electrophotographical process according to the present invention include a plastic sheet having a conductive surface, a paper sheet rendered conductive and impervious to solvents, and conductive substrate having a hydrophilic surface such as an aluminum plate, a zinc plate, bimetal plates (e.g., copper-aluminum plate, copper-stainless steel plate, chromium-copper plate), and trimetal plates (e.g., chromium-copper-aluminum plate, chromium-lead-iron plate, chromium-copper-stainless steel plate). The thickness of the conductive support is preferably from 0.1 to 3 mm, more preferably from 0.1 to 1 mm.

The support having a surface made of aluminum is preferably subjected in advance to a surface treatment such as a mechanically, chemically or electrically graining treatment, a dipping treatment in an aqueous solution of sodium silicate, potassium fluorozirconate or a phosphate, and an anodic oxidation treatment. That is, the surface treatments generally used for presensitized (PS) plates can be advantageously used in the present invention also. In addition, an aluminum plate which has undergone a graining treatment and then has been dipped in an aqueous solution of sodium silicate disclosed in U.S. Pat. No. 2,714,066, and an aluminum plate which has undergone an anodic oxidation treatment and then has been dipped in an alkali metal silicate solution disclosed in JP-B-47-5125, can be preferably used.

The foregoing anodic oxidation treatment can be carried out by making an electric current pass through an aluminum plate placed as anode in an electrolytic solution such as a single aqueous or nonaqueous solution of an inorganic acid (e.g., phosphoric acid, chromic acid, sulfuric acid and boric acid), an organic acid (e.g., oxalic acid, sulfaminic acid), or a salt of the acid as cited above, or a mixture of two or more of the above-cited solutions.

In addition, the electrodeposition of silicate disclosed in U.S. Pat. No. 3,658,662 and the treatment with polyvinylsulfonic acid disclosed in West German Patent Application (OLS) No. 1621478 are also suitable for the surface treatment.

The surface treatments as cited above are carried out not only for rendering the support surface hydrophilic, but also for preventing a harmful reaction from taking place between the support surface and a photoconductive insulation layer provided thereon, and further for heightening the adhesiveness of the support surface to a photoconductive insulation layer provided thereon.

A photoconductive layer containing the disazo compound represented by formula (I) according to the present invention is provided on the conductive support as described above, thereby forming an electrophotographic photosensitive material.

In the printing plate for electrophotographic process according to the present invention, the density of charge laid on the photoconductive layer is insufficient for development when the thickness of the photoconductive layer is too thin; while when the photoconductive layer is too thick, it suffers a side etching phenomenon in the etching step. Accordingly, the thickness of the photoconductive layer is from 0.1 to 30 μm, preferably from 0.5 to 10 μm.

In the present printing plate for electrophotographic process, an overcoating layer which can dissolve upon removal of the photoconductive insulation layer can optionally be provided on the photoconductive insulation layer, for the purpose of improving electrostatic characteristics, toner development characteristics or image characteristics of the photoconductive insulation layer. This topcoat layer may be a resin layer matted mechanically or containing a matting agent. Suitable examples of a matting agent which can be used include silicon dioxide, zinc oxide, titanium oxide, zirconium oxide, glass particles, alumina, starch, polymer particles (e.g., particles of polymethylmethacrylate, polystyrene, phenol resin) and the matting agents disclosed in U.S. Pat. Nos. 2,710,245 and 2,992,101. These matting agents can be used as a mixture of two or more thereof. A resin used for a resin layer containing the matting agent can be properly chosen depending on what kind of an etching solution is used in combination therewith. Specific examples of such a resin include gum arabic, glue, gelatin, casein, celluloses (e.g., viscose, methyl cellulose, ethyl cellulose, hydroxyethyl cellulose, hydroxypropylmethyl cellulose, carboxymethyl cellulose), starches (e.g., soluble starch, denatured starch), polyvinyl alcohol, polyethylene oxide, polyacrylic acid, polyacrylamide, polyvinyl methyl ether, epoxy resins, phenol resins (preferably those of novolak type), polyamide and polyvinyl butyral. Two or more of these resins can be used in combination.

The printing plate for electrophotographic process according to the present invention can be prepared by a conventional process. More specifically, substantially uniform charging is carried out in the dark, and then an electrostatic image is formed by imagewise exposure.

Examples of the exposure method include scanning exposure using semiconductor laser or He—Ne laser, reflex type imagewise exposure using a xenon lamp, a tungsten lamp or a fluorescent lamp as a light source, and contact exposure through a transparent positive film.

Further, the foregoing electrostatic image is developed with toner. The development herein can be performed using various conventional methods such as cascade development, magnetic brush development, powder cloud development and liquid development. Of these methods, liquid development is particularly suitable for preparing a printing plate because it can form fine images.

The toner image formed is fixed by a conventional method such as heat fixation, pressure fixation and solvent fixation. The thus fixed toner image functions as a resist in an etching step to come next. Thus, the photoconductive insulation layer is removed with an etching solution in the non-image areas alone, thereby producing a printing plate.

Examples of the etching solution used for the printing plate according to the present invention include an alkaline aqueous solution or a mixture of an alkaline aqueous solution with an organic solvent miscible therewith. The pH of the alkaline aqueous solution used for that purpose is desirably at least 9, and more preferably from 10 to 13.5. Specific examples of such an alkaline aqueous solution include aqueous solutions containing sodium hydroxide, potassium hydroxide, sodium carbonate, sodium silicate, potassium silicate, sodium metasilicate, potassium metasilicate, sodium phosphate, potassium phosphate, ammonia and an amino alcohol (e.g., monoethanolamine, diethanolamine, triethanolamine).

Examples of the organic solvent miscible with an alkaline aqueous solution include alcohols, ketones, esters and ethers.

Specific examples of the alcohols include lower alcohols (e.g., methanol, ethanol, propanol, butanol), aromatic alcohols (e.g., benzyl alcohol, phenethyl alcohol), cellosolves (e.g., ethylene glycol, diethylene glycol, triethylene glycol, polyethylene glycol), and amino alcohols (e.g., monoethanolamine, diethanolamine, triethanolamine).

Specific examples of the ketones include acetone, methyl ethyl ketone and methyl isobutyl ketone.

Specific examples of the esters include ethyl acetate, isopropyl acetate, n-propyl acetate, sec-butyl acetate, isobutyl acetate, n-butyl acetate, 1-acetoxy-2-methoxyethane and ethylene glycol diacetate.

Specific examples of the ethers include ethyl ether, tetrahydrofuran, dioxane, 2-methoxyethanol and ethylene glycol dimethyl ether.

Although an organic solvent as cited above can be mixed with the foregoing alkaline aqueous solution in any proportion, it is preferable that the solvent be used in a proportion of 90% by weight or less to the mixed solution.

To the etching solution, additives such as a surfactant, an antifoam agent and a coloring agent can be added, if desired.

After the etching processing, the printing plate obtained is subjected to a processing generally applied to a presensitized plate, e.g., a gumming operation.

It is preferable that the toner used for the printing plate according to the present invention contains a resin component capable of functioning as a resist against the etching solution as described above. Examples of the resin component include acrylic resins using methacrylic acid, an ester of methacrylic acid, vinyl acetate resins, copolymers of vinyl acetate with ethylene or vinyl chloride, vinyl chloride resins, vinylidene chloride resins, vinyl acetal resins such as polyvinyl butyral, polystyrene, copolymers of styrene with butadiene or a methacrylate, polyethylene, polypropylene and chlorination products thereof, polyester resins (e.g., polyethylene terephthalate, polyethylene isophthalate, polycarbonate of bisphenol A), polyamine resins (e.g., polycapramide, polyhexamethylene adipoamide, polyhexamethylene semicarbamide), phenol resins, xylene resins, alkyd resins, vinyl-modified alkyd resins, cellulose ester derivatives (e.g., carboxymethyl cellulose), waxes and polyolefins.

In the printing plate according to the present invention, the toner is oleophilic and the surface of the conductive substrate is hydrophilic. Herein, the terms "oleophilic" and "hydrophilic" are used for expressing in a relative sense the extent of affinity for oil or water. More specifically, the oleaginous printing inkphobic property of the surface of the substrate means that oleaginous printing ink must not adhere to and be retained by the surface of the substrate when the toner image area is adjacent to the exposed surface of the substrate, the hydrophilic property of the surface of the substrate means that the surface of the substrate can retain water thereon because of its weak resistance against water when the toner image area is adjacent to the exposed surface of the substrate; while the oleophilic property of the toner means that the toner can retain oleaginous printing ink thereon because of its weak resistance against the ink. Thus, the surface of the conductive substrate may have the oleaginous printing inkphobic property to some extent and the hydrophobic property.

The present invention will now be illustrated in more detail by reference to the following examples and comparative examples. However, it should be understood that the present invention is not to be deemed to be limited to these examples. Additionally, in the following examples and comparative examples, all parts are by weight unless otherwise indicated.

EXAMPLE 1

Five parts of a disazo compound (Compound No. 1 illustrated hereinbefore) and 5 parts of a polyester resin (Vylon 200, produced by TOYOBO CO., LTD.) were added to 50 parts of tetrahydrofuran, and dispersed thereinto over a 12-hour period by means of a ball mill. The dispersion thus obtained was applied with a wire round rod to a conductive support (a 75 μm-thick polyethylene terephthalate film having thereon a vacuum evaporation coating of aluminum, Metalme 75TS, produced by Toray Industries, Inc.), and then dried to form a charge generating layer having a thickness of 0.5 μm.

On the thus formed charge generating layer, a solution prepared by dissolving 3.6 parts of a hydrazone compound having the following structural formula (c), 4 parts of a polycarbonate resin (Panlite K-1300, produced by Teijin Limited) in the mixture of 13.3 parts of dichloromethane and 26.6 parts of 1,2-dichloromethane was coated with an applicator to form a charge transporting layer having a dry thickness of 17 μm. Thus, an electrophotographic photosensitive material containing a photosensitive layer constituted of two layers was obtained.

Formula (c)

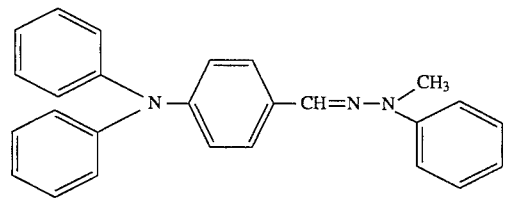

This electrophotographic photosensitive material was examined for electrophotographic characteristics by using an electrostatic duplicating paper testing apparatus (Model SP-428, produced by Kawaguchi Denki Seisakusho, Co., Ltd.) in accordance with the following process (through the measurement by a static system):

The photosensitive material charged by −6 KV corona discharge was first examined for initial surface potential $V_S$ and surface potential after 30-second standing in the dark $V_O$, and then exposed to light emitted from a tungsten lamp so that the photosensitive material surface might have an illuminance of 3 lux. Therein, the exposure amount necessary for reduction of the surface potential to one-half the initial surface potential $V_S$, which is represented by $E_{50}$, and the surface potential after 30 minutes' exposure (residual potential $V_R$) were measured separately. The procedure for those measurements was repeated 3,000 times.

The results obtained are shown in Table 1 below.

TABLE 1

| | 1st Time | 3,000th Time |
|---|---|---|
| $E_{50}$ [lux · sec] | 1.0 | 1.1 |
| $V_S$ [−V] | 930 | 910 |
| $V_O$ [−V] | 790 | 770 |
| $V_R$ [−V] | 0 | 0 |

COMPARATIVE EXAMPLES 1 TO 3

Electrophotographic photosensitive materials constituted of two layers were prepared in the same manner as in Example 1, except that disazo compounds as set forth in Table 2 (Comparative Compounds A, B and C) were used respectively in place of the disazo compound used in Example 1, and examined for $E_{50}$, $V_S$, $V_O$ and $V_R$ in accordance with the same process as in Example 1.

The results obtained are set forth in Table 2 below.

TABLE 2

| | | 1st Time | | | | 3,000th Time | | | |
|---|---|---|---|---|---|---|---|---|---|
| Compar. Example | Disazo Compound | $E_{50}$ (*1) | $V_S$ (*2) | $V_O$ (*2) | $V_R$ (*2) | $E_{50}$ (*1) | $V_S$ (*2) | $V_O$ (*2) | $V_R$ (*2) |
| 1 | A | 3.0 | 900 | 770 | 15 | 4.2 | 860 | 690 | 30 |
| 2 | B | 2.0 | 890 | 790 | 25 | 4.0 | 860 | 700 | 45 |
| 3 | C | 5.0 | 870 | 690 | 30 | 6.8 | 800 | 650 | 50 |

*1: expressed in terms of lux · sec
*2: expressed in −V

Comparative Compound A

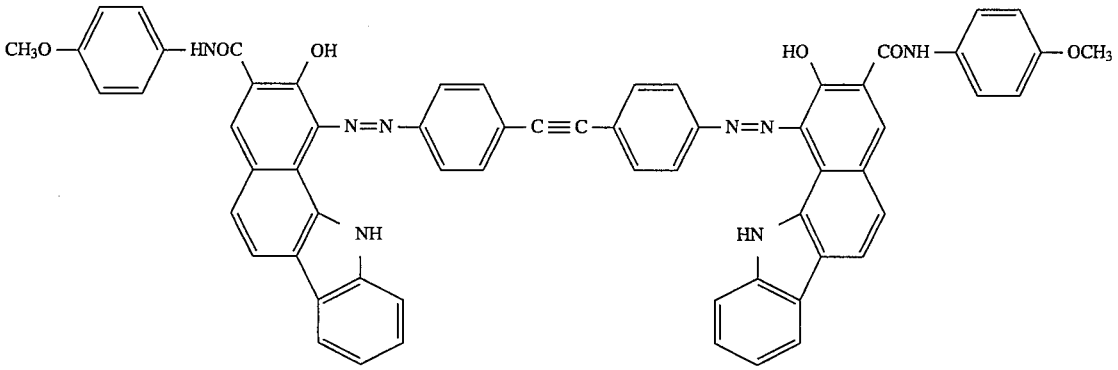

Comparative Compound B

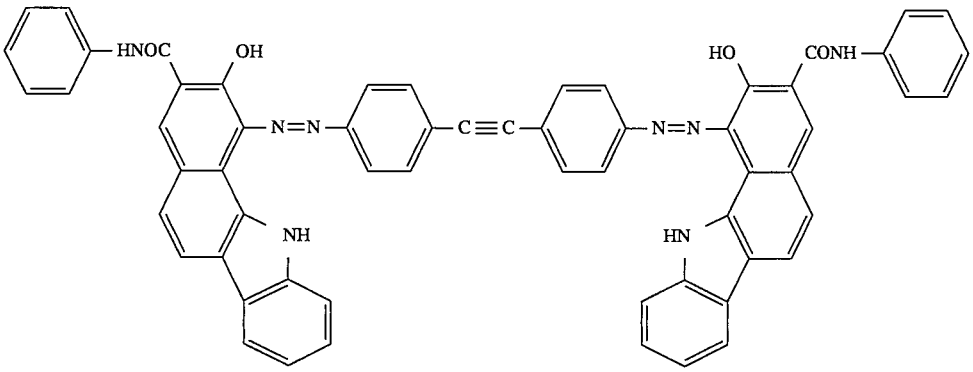

Comparative Compound C

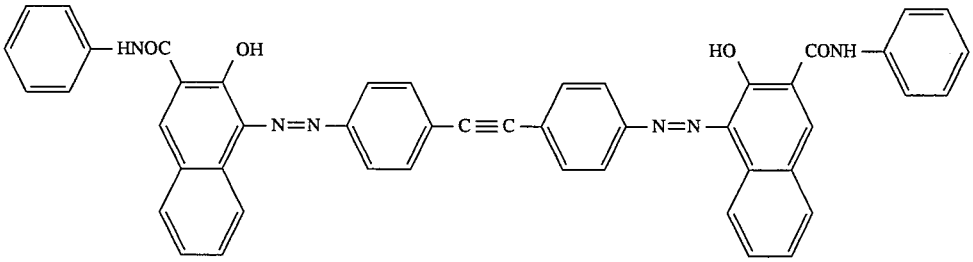

EXAMPLES 2 TO 19

Electrophotographic photosensitive materials constituted of two layers were prepared in the same manner as in Example 1, except that the present disazo compounds as set forth in Table 3 were used respectively in place of the disazo compound used in Example 1, and examined for $E_{50}$, $V_{S,\ VO}$ and $V_R$ in accordance with the same process as in Example 1.

The results obtained are shown in Table 3 below.

TABLE 3

| | | 1st Time | | | | 3,000th Time | | | |
|---|---|---|---|---|---|---|---|---|---|
| Example | Disazo Compound | $E_{50}$ (*1) | $V_S$ (*2) | $V_O$ (*2) | $V_R$ (*2) | $E_{50}$ (*1) | $V_S$ (*2) | $V_O$ (*2) | $V_R$ (*2) |
| 2 | No. 2 | 1.2 | 910 | 870 | 10 | 1.3 | 860 | 810 | 20 |
| 3 | No. 9 | 1.5 | 880 | 850 | 10 | 1.6 | 860 | 810 | 15 |
| 4 | No. 15 | 1.4 | 850 | 840 | 5 | 1.6 | 820 | 790 | 15 |
| 5 | No. 19 | 1.3 | 880 | 850 | 15 | 1.4 | 840 | 790 | 20 |
| 6 | No. 21 | 1.0 | 870 | 840 | 15 | 1.1 | 820 | 800 | 25 |
| 7 | No. 22 | 1.6 | 870 | 840 | 10 | 1.6 | 830 | 800 | 30 |

TABLE 3-continued

| Example | Disazo Compound | 1st Time $E_{50}$ (*1) | 1st Time $V_S$ (*2) | 1st Time $V_O$ (*2) | 1st Time $V_R$ (*2) | 3,000th Time $E_{50}$ (*1) | 3,000th Time $V_S$ (*2) | 3,000th Time $V_O$ (*2) | 3,000th Time $V_R$ (*2) |
|---|---|---|---|---|---|---|---|---|---|
| 8 | No. 23 | 1.2 | 910 | 870 | 10 | 1.3 | 880 | 810 | 30 |
| 9 | No. 25 | 1.3 | 870 | 840 | 20 | 1.3 | 820 | 800 | 30 |
| 10 | No. 30 | 1.2 | 850 | 840 | 10 | 1.2 | 810 | 780 | 15 |
| 11 | No. 32 | 1.1 | 920 | 890 | 5 | 1.2 | 850 | 810 | 5 |
| 12 | No. 40 | 1.4 | 900 | 850 | 5 | 1.6 | 850 | 820 | 5 |
| 13 | No. 44 | 1.3 | 890 | 860 | 0 | 1.3 | 830 | 780 | 10 |
| 14 | No. 48 | 1.2 | 890 | 860 | 0 | 1.4 | 840 | 800 | 0 |
| 15 | No. 52 | 1.1 | 870 | 840 | 10 | 1.3 | 850 | 820 | 10 |
| 16 | No. 59 | 1.2 | 860 | 830 | 5 | 1.4 | 810 | 760 | 15 |
| 17 | No. 67 | 1.5 | 870 | 840 | 10 | 1.6 | 820 | 750 | 20 |
| 18 | No. 74 | 1.4 | 880 | 860 | 10 | 1.6 | 830 | 790 | 30 |
| 19 | No. 78 | 1.2 | 870 | 830 | 0 | 1.4 | 820 | 790 | 10 |

*1: expressed in terms of lux · sec
*2: expressed in −V

EXAMPLE 20

A solution prepared by dissolving 7.5 parts of the same hydrazone compound represented by formula (c) as used in Example 1 and 10 parts of polycarbonate of bisphenol A in 50 parts of dichloromethane was applied with a wire round rod to a conductive support made of a polyethylene terephthalate film having thereon a vacuum evaporation coating of aluminum, and then dried to form a charge transporting layer having a thickness of 12 μm.

Separately, 2 parts of the same disazo compound as used in Example 1 (Compound No. 1) was dispersed into a solution containing 2 parts of a polyester resin (Vylon 200, produced by TOYOBO CO., LTD.) in 5 parts of chlorobenzene over a 1-hour period by use of a paint shaker. Thus prepared dispersion was coated on the charge transporting layer described above by means of a wire round rod, and then dried to form a charge generating layer having a thickness of 1 μm. Thus, a positively chargeable electrophotographic photosensitive material containing a photosensitive layer constituted of two layers was obtained.

This electrophotographic photosensitive material was examined for electrophotographic characteristics by using an electrostatic duplicating paper testing apparatus (Model SP-428, produced by Kawaguchi Denki Seisakusho, Co., Ltd.) in accordance with the following process (the measurement by a static system):

The photosensitive material charged positively by +6 KV corona discharge was first examined for initial surface potential $V_S$ and surface potential after 30-second standing in the dark $V_O$, and then exposed to light emitted from a tungsten lamp so that the photosensitive material surface might have an illuminance of 3 lux. Therein, the exposure amount necessary for reduction of the surface potential to one-half the initial surface potential $V_S$, which is represented by $E_{50}$, and the surface potential after 30 minutes' exposure (residual potential $V_R$) were measured separately. The procedure for those measurements was repeated 3,000 times.

The results obtained are shown in Table 4 below.

TABLE 4

| | 1st Time | 3,000th Time |
|---|---|---|
| $E_{50}$ [lux · sec] | 1.2 | 1.3 |
| $V_S$ [−V] | 870 | 820 |
| $V_O$ [−V] | 780 | 720 |
| $V_R$ [−V] | 0 | 5 |

EXAMPLE 21

Five parts of the same disazo compound as used in Example 1 (Compound No. 1), 40 parts of the same hydrazone compound as used in Example 1 (Formula (c)) and 100 parts of benzylmethacrylate-methacrylic acid copolymer ([η] 30° C. methyl ethyl ketone=0.12, methacrylic acid content: 32.9%) were added to 660 parts of dichloromethane, and dispersed for 12 hours by means of a ball mill. The dispersion thus obtained was coated on a 0.25 mm-thick aluminum plate which had undergone brush graining, electrolytic polishing, anodic oxidation of 1.5 g/m$^2$ and a silicate treatment, and then dried to form an electrophotographic printing plate material having the 6 μm-thick electrophotographic photosensitive layer.

This plate material was subjected to corona discharge (+6 KV) in the dark to gain the surface potential of 500 V. Then, the charged surface of the plate material was exposed to a tungsten light having a color temperature of 2854° K. so that the plate material surface might have an illuminance of 2.0 lux. The thus determined half decay exposure was 1.4 lux·sec.

Further, this material was charged in the dark so as to have the surface potential of +500 V, and then brought into close contact with a transparent original having a positive image, followed by exposure to light via the positive image. Thereafter, the material exposed imagewise was dipped in a liquid developer constituted of 5 g of finely granulated polymethylmethacrylate (toner) dispersed in 1000 parts of Isoper H (a petroleum solvent, produced by Esso Standard Co., Ltd.) and 0.01 g of soybean oil lecithin. Thus, a clear positive toner image was obtained.

Furthermore, the toner image was fixed by heating at 100° C. for 30 seconds. The resulting material was dipped for 1 minute in an etching solution prepared by dissolving 70 g of sodium metasilicate hydrate in a mixture of 140 parts of glycerine, 55 parts of ethylene glycol and 150 parts of ethanol, and then washed with running water as the surface thereof was softly brushed to remove the toner image-free part of the photosensitive layer. Thus, a printing plate was obtained.

The thus produced printing plate was applied to the printing operation using an offset printing machine, Hamada Star 600CD (Hamada Co., Ltd.), to provide 50,000 sheets of very clear, background stain-free prints.

As can be seen from the data set forth in Tables 1 to 4, the electrophotographic photosensitive materials using the disazo compounds according to the present invention as charge generating material had high photoreceptivity and excellent reproducibility upon repeated use.

Moreover, as can be seen from the results obtained in Example 21, the present invention can provide the prints having good quality and the print plate for electrophotographic process having excellent printing characteristics.

When the disazo compounds according to the present invention are used as charge generating material, there can be realized electrophotographic photosensitive materials having high photoreceptivity, excellent repeated-use characteristics and high uniformity in the image area, and printing plates for electrophotographic process are excellent in electrostatic characteristics and printing characteristics.

While the invention has been described in detail and with reference to specific examples thereof, it will be apparent to one skilled in the art that various changes and modifications can be made therein without departing from the spirit and scope thereof.

What is claimed is:

1. An electrophotographic photosensitive material comprising a conductive support having thereon (a) a layer containing a charge transporting compound and a charge generating compound or (b) a combination of a layer containing a charge transporting compound and a layer containing a charge generating compound, wherein a disazo compound represented by the following formula (I) as the charge generating compound is contained:

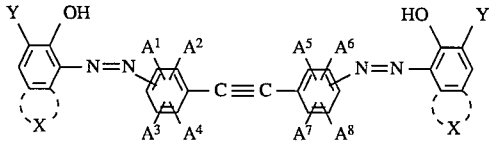

(I)

wherein $A^1$, $A^2$, $A^3$, $A^4$, $A^5$, $A^6$, $A^7$ and $A^8$ each independently represents a hydrogen atom, a substituted or unsubstituted alkyl group, an alkoxy group, a hydroxyl group, a cyano group, a nitro group, a halogen atom, a trifluoromethyl group, an amino group, a carboxyl group, an alkoxycarboxyl group, an aryloxycarboxyl group, an alkylcarbonyl group or an arylcarbonyl group;

X represents an atomic group necessary for forming an aromatic ring or a heteroaromatic ring by fusing together with a benzene ring in formula (I) to which a hydroxyl group and Y are attached; and Y represents —$CONR^1R^2$ or —$COOR^2$, in which $R^1$ represents a hydrogen atom, an alkyl group or an aryl group; and $R^2$ represents a group represented by the following formula (II):

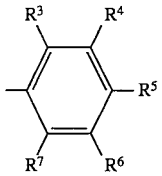

(II)

wherein $R^3$, $R^4$, $R^5$, $R^6$ and $R^7$ each independently represents a hydrogen atom, an alkyl group, an alkoxy group, a hydroxyl group, a cyano group, a nitro group, a halogen atom, a trifluoromethyl group, an amino group, a carboxyl group, an alkylcarbonyl group or an arylcarbonyl group, provided that at least one of $R^3$, $R^4$, $R^5$, $R^6$ and $R^7$ is a group selected from —$CO_2R^8$, —$CONR^9R^{10}$, —$SO_2R^8$, —$SO_3H$, —$SO_2NR^9R^{10}$, —$NR^9COR^{11}$ and —$NR^9SO_2R^{11}$, in which $R^8$ represents an alkyl group, an aryl group or a heteroaromatic ring group; and $R^9$, $R^{10}$ and $R^{11}$ each independently represents a hydrogen atom, an alkyl group or an aryl group.

2. A printing plate for electrophotographic process, which is prepared by subjecting an electrophotographic photosensitive material comprising a conductive support having thereon a photoconductive layer containing at least a charge generating material, a charge transporting material and a binder resin to an imagewise exposure and a development to form a toner image, and by removing a non-image area of the photoconductive layer other than the toner image areas thereof, wherein at least one charge generating material is a disazo compound represented by the following formula (I):

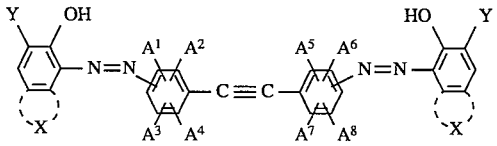

(I)

wherein $A^1$, $A^2$, $A^3$, $A^4$, $A^5$, $A^6$, $A^7$ and $A^8$ each independently represents a hydrogen atom, a substituted or unsubstituted alkyl group, an alkoxy group, a hydroxyl group, a cyano group, a nitro group, a halogen atom, a trifluoromethyl group, an amino group, a carboxyl group, an alkoxycarboxyl group, an aryloxycarboxyl group, an alkylcarbonyl group or an arylcarbonyl group;

X represents an atomic group necessary for forming an aromatic ring or a heteroaromatic ring by fusing together with a benzene ring in formula (I) to which a hydroxyl group and Y are attached; and Y represents —$CONR^1R^2$ or —$COOR^2$, in which $R^1$ represents a hydrogen atom, an alkyl group or an aryl group; and $R^2$ represents a group represented by the following formula (II):

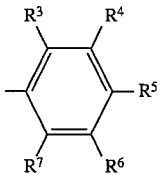

(II)

wherein $R^3$, $R^4$, $R^5$, $R^6$ and $R^7$ each independently represents a hydrogen atom, an alkyl group, an alkoxy group, a hydroxyl group, a cyano group, a nitro group, a halogen atom, a trifluoromethyl group, an amino group, a carboxyl group, an alkylcarbonyl group or an arylcarbonyl group, provided that at least one of $R^3$, $R^4$, $R^5$, $R^6$ and $R^7$ is a group selected from —$CO_2R^8$, —$CONR^9R^{10}$, —$SO_2R^8$, —$SO_3H$, —$SO_2NR^9R^{10}$, —$NR^9COR^{11}$ and —$NR^9SO_2R^{11}$, in which $R^8$ represents an alkyl group, an aryl group or a heteroaromatic ring group; and $R^9$, $R^{10}$ and $R^{11}$ each independently represents a hydrogen atom, an alkyl group or an aryl group.

* * * * *